US012181196B2

(12) United States Patent
Sharma et al.

(10) Patent No.: US 12,181,196 B2
(45) Date of Patent: Dec. 31, 2024

(54) EVAPORATOR ASSEMBLY FOR A VERTICAL FLOW TYPE ICE MAKING MACHINE

(71) Applicants: Ram Prakash Sharma, Gurugram (IN); Vinay Sharma, Gurugram (IN)

(72) Inventors: Ram Prakash Sharma, Gurugram (IN); Vinay Sharma, Gurugram (IN)

( * ) Notice: Subject to any disclaimer, the term of this patent is extended or adjusted under 35 U.S.C. 154(b) by 0 days.

(21) Appl. No.: 17/263,105

(22) PCT Filed: Sep. 24, 2020

(86) PCT No.: PCT/IB2020/058938
§ 371 (c)(1),
(2) Date: Jan. 25, 2021

(87) PCT Pub. No.: WO2021/059185
PCT Pub. Date: Apr. 1, 2021

(65) Prior Publication Data

US 2022/0034569 A1 Feb. 3, 2022

(30) Foreign Application Priority Data

Sep. 24, 2019 (IN) ..... 201911038514

(51) Int. Cl.
*F25C 1/12* (2006.01)
*F25C 1/246* (2018.01)

(52) U.S. Cl.
CPC ..... *F25C 1/12* (2013.01); *F25C 1/246* (2013.01)

(58) Field of Classification Search
CPC .... F25C 1/12; F25C 1/246; F25C 1/24; F25B 39/02; F25D 21/12
(Continued)

(56) References Cited

U.S. PATENT DOCUMENTS 2,181,580 A 11/1939 Fitzsimmons
2,870,612 A * 1/1959 Garland ..... F25C 1/12 62/157

(Continued)

FOREIGN PATENT DOCUMENTS

JP H0658656 A 3/1994
JP H1096574 A 4/1998
WO 2019106524 A1 6/2019

OTHER PUBLICATIONS

International Application No. PCT/IB2020/058938, International Search Report and Written Opinion dated Dec. 23, 2020.

(Continued)

*Primary Examiner* — Eric S Ruppert
*Assistant Examiner* — Kirstin U Oswald
(74) *Attorney, Agent, or Firm* — Quarles & Brady, LLP

(57) ABSTRACT

An evaporator assembly for an ice machine is disclosed. The assembly comprises of a frame, a plurality of first cooling surfaces that are spaced at a distance and extend in a first direction within the frame. The assembly also includes a plurality of second cooling surfaces which extend in a second direction perpendicular to the first direction within the frame. An intersection of the plurality of first and second cooling surfaces defines a plurality of ice forming blocks. Further, at least one conductive wall having a first surface and a second surface is provided. The first surface of the conductive wall is configured to accommodate the plurality of ice forming blocks and the second surface of the conductive wall is configured to come in contact with refrigerant or defrost fluid.

19 Claims, 23 Drawing Sheets

(58) Field of Classification Search
USPC ..... 62/340
See application file for complete search history.

(56) References Cited

U.S. PATENT DOCUMENTS

| | | | | | |
|---|---|---|---|---|---|
| 3,220,205 | A * | 11/1965 | Breeding | F25C 1/12 | 62/73 |
| 3,430,452 | A * | 3/1969 | Dedricks | F25C 1/12 | 62/347 |
| 4,452,049 | A * | 6/1984 | Nelson | F25C 5/10 | 62/352 |
| 4,580,410 | A * | 4/1986 | Toya | F25C 1/12 | 62/352 |
| 4,823,559 | A * | 4/1989 | Hagen | F25C 1/12 | 62/347 |
| 4,903,504 | A * | 2/1990 | Nelson | F25C 1/12 | 62/347 |
| 4,986,088 | A * | 1/1991 | Nelson | F25C 1/12 | 62/347 |
| 5,105,632 | A * | 4/1992 | Naruse | F25C 5/10 | 62/352 |
| 5,237,837 | A * | 8/1993 | Naruse | G01F 23/74 | 62/347 |
| 5,419,151 | A * | 5/1995 | Minari | F25C 1/12 | 62/352 |
| 6,247,318 | B1 * | 6/2001 | Stensrud | F28F 1/22 | 29/890.035 |
| 6,286,331 | B1 | 9/2001 | Lee | | |
| 8,677,774 | B2 | 3/2014 | Yamaguchi | | |
| 2006/0191281 | A1 | 8/2006 | Feldman | | |
| 2006/0288725 | A1 * | 12/2006 | Schlosser | F28F 1/022 | 62/347 |
| 2008/0104991 | A1 | 5/2008 | Hoehne | | |
| 2011/0005263 | A1 | 1/2011 | Yamaguchi | | |

OTHER PUBLICATIONS

International Application No. PCT/IB2020/058938, International Preliminary Report on Patentability (IPER), completed Apr. 8, 2021.

* cited by examiner

EVAPORATOR ASSEMBLY FOR A VERTICAL FLOW TYPE ICE MAKING MACHINE

CROSS-REFERENCE TO RELATED APPLICATIONS

This application is a national phase application pursuant to 35 U.S.C. § 371 of International Application No. PCT/IB2020/058938 filed Sep. 24, 2020, which claims priority to Indian patent application No. 201911038514 filed Sep. 24, 2019, the disclosures of which are incorporated by reference herein.

TECHNICAL FIELD

Present disclosure in general relates to a field of refrigeration. Particularly, but not exclusively, the present disclosure relates to an ice making machine. Further embodiments of the present disclosure disclose an evaporator assembly for a vertical flow type ice making machine, to produce ice cubes.

BACKGROUND OF THE DISCLOSURE

Ice is formed by exposing water to sub-zero temperatures. When water is exposed to freezing temperatures, water turns from a liquid state to a solid state. Ice of different shapes and sizes may be produced by moulds of predetermined shapes. Initially, water that is to be frozen poured into a mould of predetermined shape. The mould is then exposed to sub-zero temperatures which causes the water in the mould to freeze. As the water turns into a solid state, the water acquires the shape of the mould and thus ice blocks in the shape of the mould are obtained. Generally, household refrigerators use ice trays with a cubical shape, wherein the refrigerators and the ice trays are suitable to produce a small amount of ice. However, certain sectors such as the food sector, the beverage sector, the cold storage sectors etc. use large quantities of ice with specific requirement in shape and size. Ice of smaller sizes are generally used in the food/beverage sectors such as restaurants and hotels. In recent times, the food and beverage industries have had an increased demand for ice. Hence, there exists a need in the food/beverage sector to manufacture ice in large quantities in a shorter period of time. The different shapes of ice that may be served in the food and the beverage industries also seems to be aesthetically pleasing to the consumers.

Typically, ice blocks may be created by pouring water or liquid into mould of predetermined shape and these moulds would be subjected to sub-zero temperatures to form ice. However, such process is time consuming and tedious and thus production of large quantities of ice becomes difficult. Also, the ice blocks that are produced conventionally may break during harvest.

With advancements in the technology, automatic ice making machines have been developed and used in many sectors. These automatic ice making machines minimize human intervention by making ice in required shape and size. Ice making machines are often adapted in sectors which require ice in bulk quantities such as food or beverage sectors. Ice making machines comprise of a large water tank which stores the water that is to be frozen. The water from the water tank may be fed by a pump to a water flow line. The water from the water flow line further flows onto a plurality of cooling surfaces on an evaporator frame. The evaporator frame may comprise a plurality of rectangular ice forming blocks or ice forming blocks of any other suitable shape may be configured onto the evaporator frame. One end of the plurality of rectangular ice forming blocks are fixedly connected to one end of a backplate. The other end of the backplate is provided with a refrigerant tube. As the refrigerant flows through the refrigerant tubes, the water that flows on the cooling surfaces turns into ice since the heat from the water is absorbed by the refrigerant tubes through the backplate of the evaporator frame. The backplate forms the cooling surface which cools and solidifies the water that flows through it. As the water solidifies on the cooling surface, the ice that is being formed takes the shape of the ice forming blocks that are provided on the backplate of the evaporator frame.

In configurations of the evaporator assemblies as mentioned above, heat from the flowing water is often absorbed by the refrigerant in the refrigerant tubes through an intermediate surface such as the backplate. Hence, the overall efficiency of the evaporator assembly may be significantly low. Thus, the overall cold storage energy of the refrigerant that is required to cool the stream of flowing water, significantly increases. Also, since the heat transfer between the refrigerant tubes and the stream of flowing water takes place by an intermediate backplate, the operational temperature at which the refrigerant flows through the refrigerant tubes has to be significantly decreased or the duration for which the refrigerant is circulated through the refrigerant tubes has to be significantly increased for the ice to be formed in the ice forming blocks of the evaporator assembly. Hence the conventional evaporator assemblies often require more time for the ice to be produced and the subsequent operational temperature of the refrigerant must be significantly low. Consequently, the overall operational costs of the evaporator assembly increase significantly.

Further, the evaporators include multiple surfaces which are often not accessible by hand to the user and therefore the cleaning of these parts is often not possible. Due to constant flow of water through theses evaporators, bacteria may be formed on the surfaces and ice cubes obtained are often very un-hygienic. Further, assembling of conventional evaporators is complex and involves multiple parts which are often not accessible for disassembling. Consequently, cleaning of the evaporator assemblies by disassembling the evaporators becomes complex and a skilled technician is required for disassembling and cleaning the evaporators. Further, conventional evaporators include hidden areas of the evaporator which are mostly not accessible for cleaning. Consequently, any formation of bacteria or other impurities goes unnoticed. These impurities become a part of the water which flows through theses surfaces and ultimately ice is formed with these impurities.

The "U.S. Pat. No. 4,580,410A" discloses an apparatus for making ice product that has a vertically arranged refrigerating plate having a freezing surface and a refrigerant pipe on the side of the plate, opposite to said freezing surface. A flushing water spray pipe is arranged on the upper portion of the aforementioned side of the refrigerating plate, with the ice-making water flowing down along the freezing surface for formation of ice products. The above application discloses a configuration where the refrigerant plate is provided for ice formation and the refrigerant pipe is configured behind the refrigerant plate, due to which the refrigerant has to absorb the heat of multiple surfaces i.e. the refrigerant tube and the refrigerant plate. Consequently, multiple surfaces results in lower operational efficiency.

Further, the "U.S. Pat. No. 8,677,774B2" discloses ice making machine where ice making portion is configured to dispose a pair of ice making plates having back faces facing each other and sandwiching the evaporation tube. The above patent also discloses a configuration where evaporator tube along with two plates are used for making ice. As a result of multiple conductive surfaces (i.e. the surface of evaporation tubes and the surface of the ice making plates) the refrigerant has to absorb heat from multiple surfaces before absorbing the heat from the water flowing on the ice making plates. Consequently, the refrigerant has to be circulated inside the evaporation tube for a longer period of time for ice to be formed on the ice making plates which reduces the operational efficiency of the ice making machine and increases the time required for forming an ice block.

The patent publication no. "US20110005263A1" also discloses a configuration where ice the making plates are disposed facing each other approximately vertically sandwiching an evaporation tube. This configuration also comprises of plurality of surfaces due to which the heat loss increases and the overall operational efficiency of the ice making machine is reduced. The time required for forming an ice block is consequently increased. Also, the evaporators of the above-mentioned documents include multiple hidden surfaces which makes it difficult for the user to detect and clean any impurities.

The present disclosure is directed to overcome one or more limitations stated above or any other limitation associated with the conventional arts.

SUMMARY OF THE DISCLOSURE

One or more shortcomings of the conventional processes are overcome by providing plurality of channels that are defined by a conductive wall. The conductive wall is defined by a first and a second surface, where the first surface comes in contact with water and the second surface of the same conductive wall comes in contact with a refrigerant. Consequently, the ice to be formed at a faster rate and increases the overall operational efficiency of the evaporator assembly.

In a non-limiting embodiment of the present disclosure, an evaporator assembly for a vertical flow type ice making machine is disclosed. The evaporator assembly includes a frame and a plurality of first cooling surfaces. The plurality of first cooling surfaces is each spaced at a distance and extend in a first direction within the frame. Further, a plurality of second cooling surfaces are spaced at a distance and extend in a second direction perpendicular to the first direction within the frame. An intersection of the plurality of first and second cooling surfaces defines a plurality of ice forming blocks. At least one conductive wall having a first surface and a second surface is provided where, the first surface of the conductive wall is configured to accommodate the plurality of ice forming blocks and the second surface of the conductive wall is configured to come in contact with at least one of refrigerant and defrost fluid.

In an embodiment of the disclosure, the second surface of each of the at least one conductive wall is defined with a plurality of channels.

In an embodiment of the disclosure, each of the plurality of the channels is formed by configuring two of the at least one conductive walls, such that second surface of the at least one conductive walls face each other.

In an embodiment of the disclosure, the frame is made of a non-conductive material.

In an embodiment of the disclosure, the plurality of first direction is a vertical direction and the second direction is the horizontal direction.

In an embodiment of the disclosure, the second cooling surfaces are defined with a plurality of slots for accommodating the plurality of first cooling surfaces.

In an embodiment of the disclosure, each of the plurality of channels are configured vertically one above the other.

In an embodiment of the disclosure, the plurality of channels is defined by a plurality of rectangular tubes positioned one above the other.

In an embodiment of the disclosure, a top end of each conductive wall is fixedly connected to the horizontal cooling surface.

In an embodiment of the disclosure, at least one conductive strip extending from a plurality of channels to a fluid tank provided below the evaporator assembly.

In an embodiment of the disclosure, at least one pivotable flap is connected to the frame.

In an embodiment of the disclosure, the frame houses at least one water flow line and at least one defrost fluid spray line.

In an embodiment of the disclosure, at least one side plate arranged parallel to the plurality of vertical cooling surfaces and is configured to enclose the plurality of ice forming blocks.

In an embodiment of the disclosure, the plurality of ice forming blocks come in direct contact with conductive walls of the refrigerant tubes.

In an embodiment of the disclosure, the conductive walls, and the horizontal cooling surfaces at the top end of the conductive walls are formed from a single metallic sheet.

In an embodiment of the disclosure, the conductive walls are of a curled profile.

In a non-limiting embodiment of the present disclosure, a vertical flow type ice making machine is disclosed. The machine includes one or more evaporator assemblies. Each of the one or more evaporator assemblies include a frame and a plurality of first cooling surfaces. The plurality of first cooling surfaces are each spaced at a distance and extend in a first direction within the frame. Further, a plurality of second cooling surfaces are spaced at a distance and extend in a second direction perpendicular to the first direction within the frame. An intersection of the plurality of first and second cooling surfaces defines a plurality of ice forming blocks. At least one fluid flow line is positioned at upstream side of each of the one or more evaporator assemblies for supplying liquid onto the plurality of ice forming blocks.

Further, at least one conductive wall having a first surface and a second surface is provided where, the first surface of the conductive wall is configured to accommodate the plurality of ice forming blocks and the second surface of the conductive wall is configured to come in contact with at least one of refrigerant and defrost fluid. At least one defrost fluid tube is positioned in upstream side of the plurality of conductive walls for selectively supplying the defrost fluid onto the plurality of conductive walls.

The foregoing summary is illustrative only and is not intended to be in any way limiting. In addition to the illustrative aspects, embodiments, and features described above, further aspects, embodiments, and features will become apparent by reference to the drawings and the following description.

BRIEF DESCRIPTION OF THE ACCOMPANYING DRAWINGS

The novel features and characteristic of the disclosure are set forth in the appended description. The disclosure itself, however, as well as a preferred mode of use, further objectives, and advantages thereof, will best be understood by reference to the following description of an illustrative embodiment when read in conjunction with the accompanying figures. One or more embodiments are now described, by way of example only, with reference to the accompanying figures wherein like reference numerals represent like elements and in which.

Figure 1:
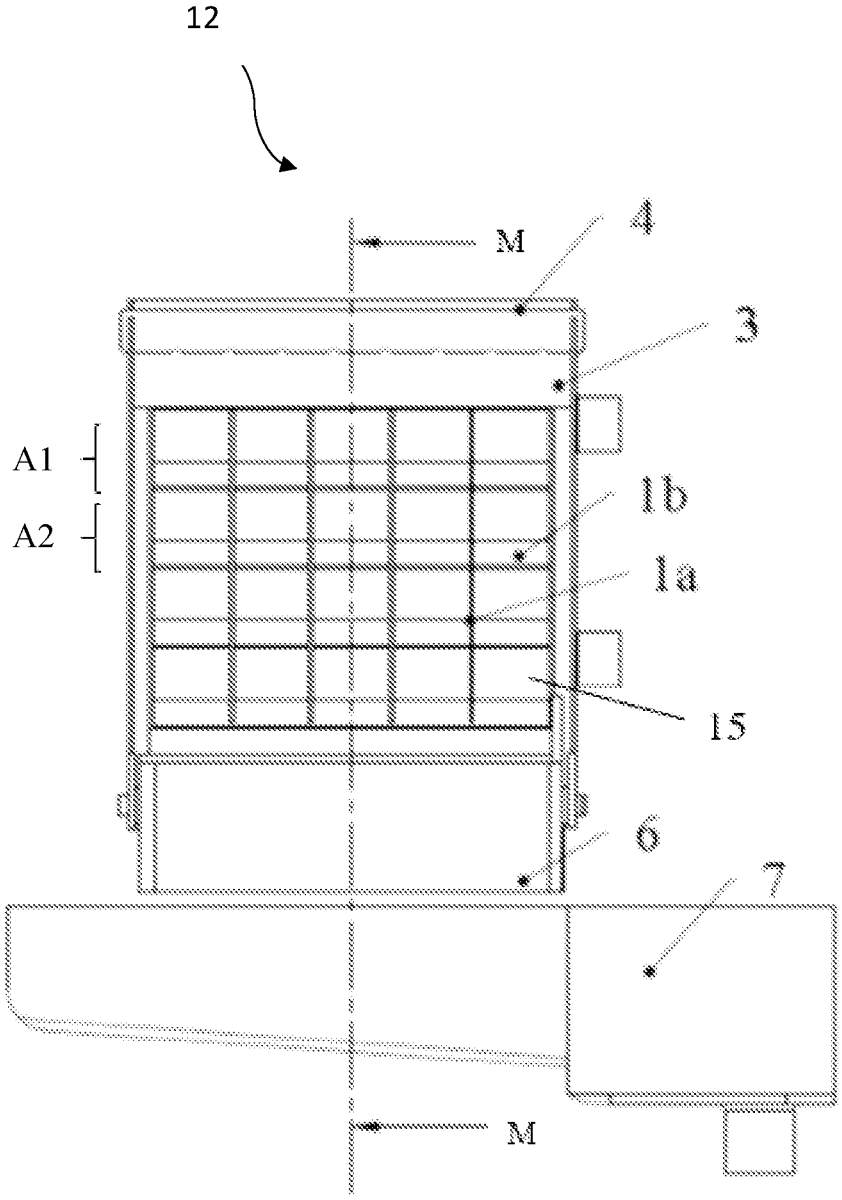
FIG. 1 illustrates a schematic front view of an evaporator assembly with a fluid reservoir employed in the ice making machine, in accordance with an embodiment of the present disclosure.

The figures depict embodiments of the disclosure for purposes of illustration only. One skilled in the art will readily recognize from the following description that alternative embodiments of the system illustrated herein may be employed without departing from the principles of the disclosure described herein.

DESCRIPTION

The foregoing has broadly outlined the features and technical advantages of the present disclosure in order that the description of the disclosure that follows may be better understood. Additional features and advantages of the disclosure will be described hereinafter which form the subject of the disclosure. It should be appreciated by those skilled in the art that the conception and specific embodiment disclosed may be readily utilized as a basis for modifying or designing other devices for carrying out the same purposes of the present disclosure. It should also be realized by those skilled in the art that such equivalent constructions do not depart from the spirit and scope of the disclosure. The novel features which are believed to be characteristic of the disclosure, as to its organization, together with further objects and advantages will be better understood from the following description when considered in connection with the accompanying figures. It is to be expressly understood, however, that each of the figures is provided for the purpose of illustration and description only and is not intended as a definition of the limits of the present disclosure.

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiment thereof has been shown by way of example in the drawings and will be described below. It should be understood, however that it is not intended to limit the disclosure to the particular forms disclosed, but on the contrary, the disclosure is to cover all modifications, equivalents, and alternative falling within the scope of the disclosure.

The terms "comprises", "comprising", or any other variations thereof, are intended to cover a non-exclusive inclusion, such that an assembly that comprises a list of components does not include only those components but may include other components not expressly listed or inherent to such assembly. In other words, one or more elements in the device or assembly proceeded by "comprises . . . a" does not, without more constraints, preclude the existence of other elements or additional elements in the assembly.

Embodiments of the present disclosure discloses an evaporator assembly for a vertical flow type ice machine. In conventional evaporator assemblies, the heat from the flowing water is often absorbed by the refrigerant in the refrigerant tubes through an intermediate surface such as backplate. Since the heat transfer between the refrigerant tubes and the stream of flowing water takes place through the intermediate backplate, the operational temperature at which the refrigerant flows through the refrigerant tubes has to be significantly decreased or the duration for which the refrigerant should be circulated through the refrigerant tubes has to be significantly increased. Hence the conventional evaporator assemblies often require more time to form the ice. Consequently, reducing the efficiency of the ice making machine and the overall operational costs of the evaporator assembly increases significantly.

Therefore, the present disclosure discloses an evaporator assembly for a vertical flow type ice making machine to overcome the limitations of the conventional assemblies.

The evaporator assembly of the present disclosure comprises of a plurality of evaporator frames. Each of the plurality of evaporator frames may include a plurality of cooling surfaces, wherein the cooling surfaces may be configured to form a number of ice forming blocks. Further, a plurality of channels defined by multiple conductive walls is provided between the evaporator frames, such that the plurality of ice forming blocks come in direct contact with the plurality of conductive walls. Each conductive wall of the plurality of conductive walls may be defined with a first surface and a second surface and the conductive walls may be configured parallel to each other such that a channel is defined between the conductive walls. The second surfaces of the parallel conductive walls may face each other to define a channel. The first surface acts as the base surface for the plurality of ice forming blocks. The ice forming blocks are sealed at one end by the first surface of the conductive wall whereas the other end of the ice forming blocks remain open for the flow of fluid. Further, during a cooling cycle, the fluid flows on the cooling surfaces and comes in direct contact with the first surface of the conductive walls, where the refrigerant in the channel defined by the conductive walls causes the fluid to solidify and form ice. Thus, ice may be formed layer by layer inside each of the ice blocks and the ice gradually takes the shape of the ice forming blocks. Further, during a harvest cycle, a heated defrost fluid may be sprayed onto the plurality of refrigerant tubes. The heated defrost fluid causes the ice in the plurality of ice forming blocks to partially melt. The ice gets detached from the surface of the refrigerant tube and falls onto the flap. The flap further directs the ice blocks onto an ice storage container.

The following paragraphs describe the present disclosure with reference to FIGS. 1 to 32.

FIG. 1 illustrates a front view of an evaporator assembly (12) with a fluid reservoir (7) employed in the ice making machine (11). The ice making machine (11) comprises of an evaporator assembly (12) and an evaporator frame (3). The evaporator frame (3) comprises of a plurality of first cooling surfaces (1*a*) and second cooling surfaces (1*b*). The first cooling surfaces (1*a*) are configured in a first direction i.e. the vertical direction and will further be referred to as vertical cooling surfaces (1*a*). The second cooling surfaces (1*b*) are configured along the second direction which is horizontal direction and will further be referred to as horizontal cooling surfaces (1*b*). The vertical and horizontal cooling surfaces (1*a* and 1*b*) may be configured to form ice forming blocks (A) or ice making regions of different shapes. As seen from FIG. 1, the vertical and the horizontal cooling surfaces (1*a* and 1*b*) may form a rectangular or square shaped ice forming blocks (A). In an embodiment, the plurality of cooling surfaces (1) forms a plurality of ice forming blocks (A). Further, the evaporator frame (3) is also provided with a fluid flow line (4). As seen from FIG. 7, a plurality of conduits may be configured at the top end of the frame (3). In an embodiment, the fluid flow line (4) may be supported by suitable means and may be detachably attached to the top portion of the evaporator frame (3). The fluid flow line (4) may further be coupled to a fluid tank (7). The fluid from the fluid tank (7) may be pumped to the fluid flow line (4), where the fluid flow line (4) may be provided with a plurality of apertures [not shown] at the bottom surface of the fluid flow line (4). The fluid flows out of the fluid flow line (4), through the apertures along the plurality of horizontal cooling surfaces (1*b*). Further, the evaporator assembly (12) is also configured with a plurality of channels (C).

Figure 3:
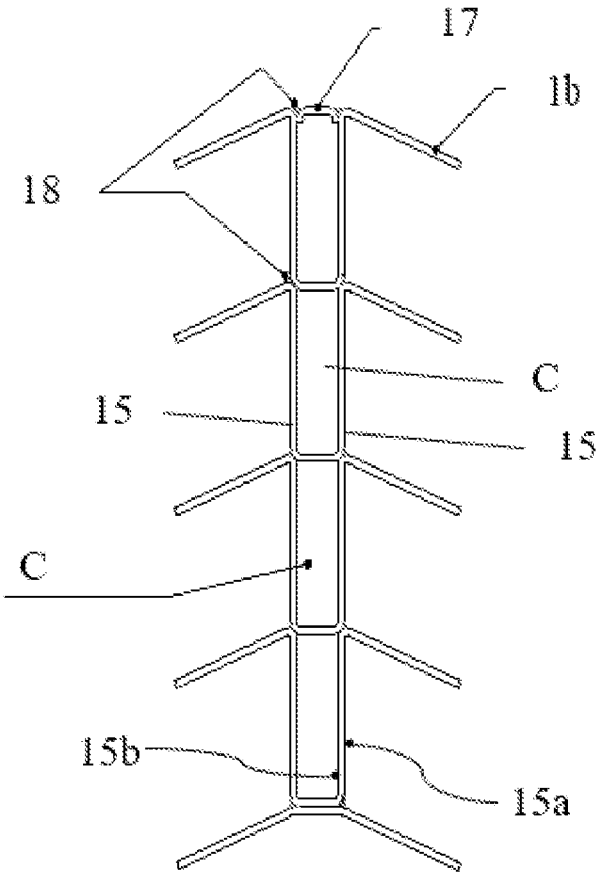
FIG. 3 illustrates schematic side view of an evaporator assembly employed in the ice making machine showing plurality of channels defined by parallel conductive walls which are arranged vertically, in accordance with an embodiment of the present disclosure.

Each of the plurality of channels (C) may be defined by configuring a single metallic component into two parallel conductive walls (15) as seen from FIG. 3. Further, the cooling surfaces (1) on the evaporator frame (3) form the plurality of ice forming blocks (A), where one end of the ice forming block (A) remains open and the other end of the ice forming blocks (A) are sealed by the conductive walls (15). Further, the evaporator assembly (12) includes a defrost fluid spray (5). As seen from the FIG. 9, the defrost fluid spray (5) may be used to supply or spray hot fluid i.e. fluid at a relatively higher temperature onto the plurality of channels (C). The defrost fluid line (5) may be coupled to a suitable defrost fluid tank [not shown], wherein the defrost fluid form the defrost fluid tank may be pumped to the defrost fluid line (5). Further, as seen from the FIG. 1, the evaporator frame (3) is provided with a flap (6) at its bottom surface and the flap (6) is pivotally coupled to the evaporator frame (3). The evaporator frame (3) may also be provided with a plurality of extended surfaces to which the flap (6) may be pivotally coupled by means of a hinge.

In an embodiment of the disclosure, the evaporator frame (3) may be made of plastic or other suitable polymeric material.

In an embodiment of the disclosure, an elongated cut-out section may be provided on the bottom of the fluid flow lines (4) for a continuous supply of fluid throughout the evaporator frame (3).

In an embodiment of the disclosure, the plurality of cooling surfaces (1) may be configured in different shapes, so as to form circular and/or oval and/or triangular shaped ice forming blocks (A). The person skilled in the art may also configure the cooling surface (A) to form other random or fixed geometrical shapes as per desired shape of ice blocks (8).

Figure 2:
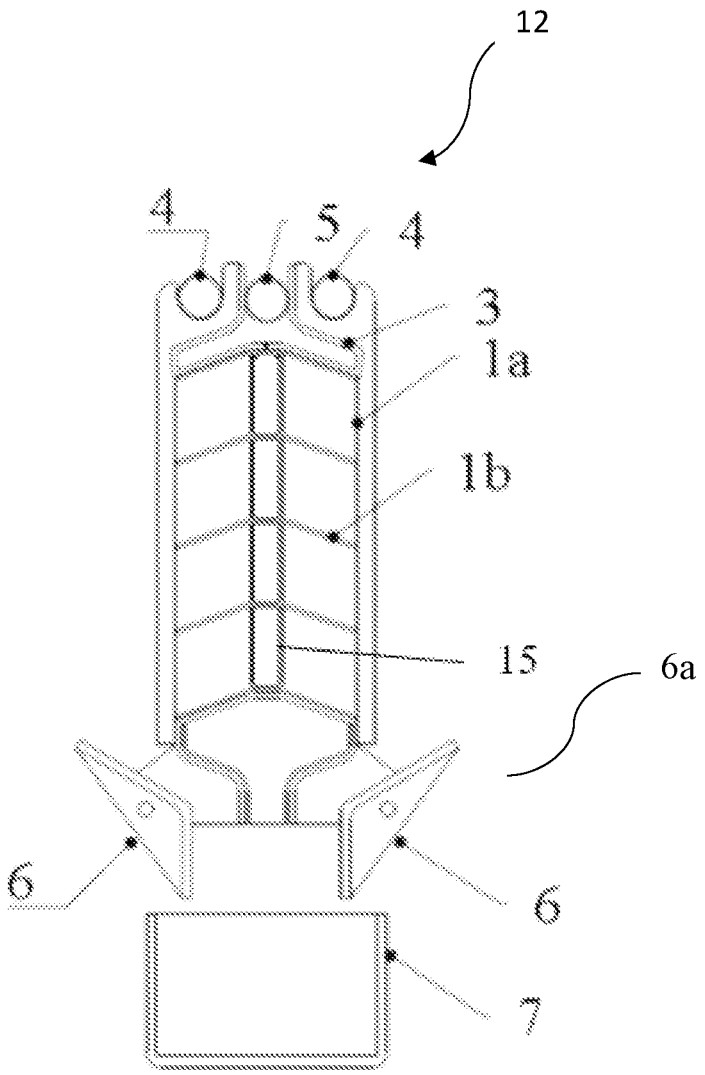
FIG. 2 illustrates a sectional side view of the evaporator assembly with the fluid reservoir employed in the ice making machine along axis M-M of FIG. 1, in accordance with an embodiment of the present disclosure.

Referring now to FIG. 2, is a side view of an evaporator assembly (12) with a fluid reservoir (7) employed in the ice making machine (11) representing a sectional view taken along section M-M of FIG. 1. The evaporator assembly (12) of the ice making machine (11) may have a symmetrical configuration with the evaporator frames (3) on either side of the plurality of channels (C). The plurality of cooling surfaces (1) on either side of the plurality of channels (C) may form a plurality of rectangular or square ice forming blocks (A) as seen in FIG. 2. Further, the defrost fluid spray (5) is housed at the centre of the evaporator assembly (12). The defrost fluid spray (5) is positioned just above the plurality of channels (C) such that the defrost fluid spray (5) supplies or sprays hot fluid onto the conductive walls (15) of the plurality of channels (C). Also, two water flow lines (4) are provided on either sides of the defrost fluid spray (5) and the water flow lines (4) supply water through a plurality of apertures to the ice forming blocks (A). Further, the flaps (6) may also be provided on sides of the evaporator frame (3). As seen from the FIG. 2, one side of the ice forming blocks (A) may remain open for enabling the flow of water that is to be cooled and solidified whereas the other end of the ice forming blocks (A) may be sealed by conductive walls (15) of the channel (C).

Figure 4:
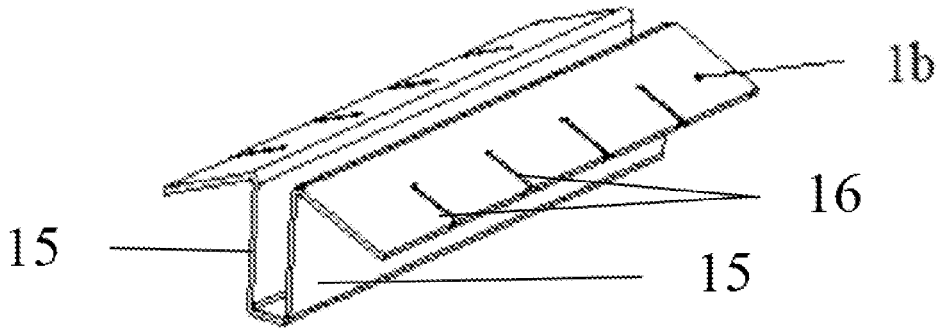
FIG. 4 illustrates a channel defined by parallel conductive walls, where the top end of each of the conductive walls are connected to a horizontal cooling surface, in accordance with an embodiment of the present disclosure.

FIG. 3 illustrates a plurality of channels (C) defined by parallel conductive walls (15) which are arranged vertically, and FIG. 4 illustrates a single channel (C) defined by parallel conductive walls (15). Any conductive metallic sheet may be shaped or formed to define two parallel conductive walls (15). The metallic sheet may be formed such that the two parallel conductive walls (15) may be separated by a small pre-determined distance. The two parallel conductive walls (15) are thus shaped to define a channel (C) or a conduit. The conductive walls (15) are also defined by a first surface (15*a*) and a second surface (15*b*). The refrigerant flows inside the channel (C) and the refrigerant comes in contact with the second surface (15*b*) of the conductive walls (15). Further, the channel (C) is configured such that the second surface (15*b*) of the two conductive walls (15) face each other. The first surface (15*a*) of the conductive walls (15) accommodate the vertical cooling surfaces (1*a*) and the first surface (15*a*) of the conductive walls (15) enclose the ice forming blocks (A) at one end. Further, the top end of each of the plurality of conductive walls (15) may be connected to the horizontal cooling surface (1*b*). The two parallel conductive walls (15) with the horizontal cooling surfaces (1*b*) at the top end of the conductive walls (15) may be formed from a single metallic sheet. In an embodiment, the horizontal cooling surfaces (1*b*) may be separately joined or connected to the top end of the conductive walls (15) by soldering or by any other method known in the art. The horizontal cooling surfaces (1*b*) may also be provided with a plurality of slots (16) for accommodating the vertical cooling surfaces (1*a*) as seen from the FIG. 4. The slots (16) may be equidistant, and the slots (16) extend through the width of the horizontal cooling surface (1*b*). Further, a plurality of channels (C) may be configured one above the another as seen from FIG. 3. The bottom end of each channel (C) may be positioned between the top end of the conductive walls (15) and the bottom end of the conductive walls (15) may be thermally joined, for example, soldered (18) to the top end of the consecutive conductive walls (15). Thus, multiple enclosed channels (C) may be formed which facilitate the flow of refrigerant. The top end of the top channel (C) may be enclosed by soldering or connecting a cap (17) between the conductive walls (15).

Figure 5:
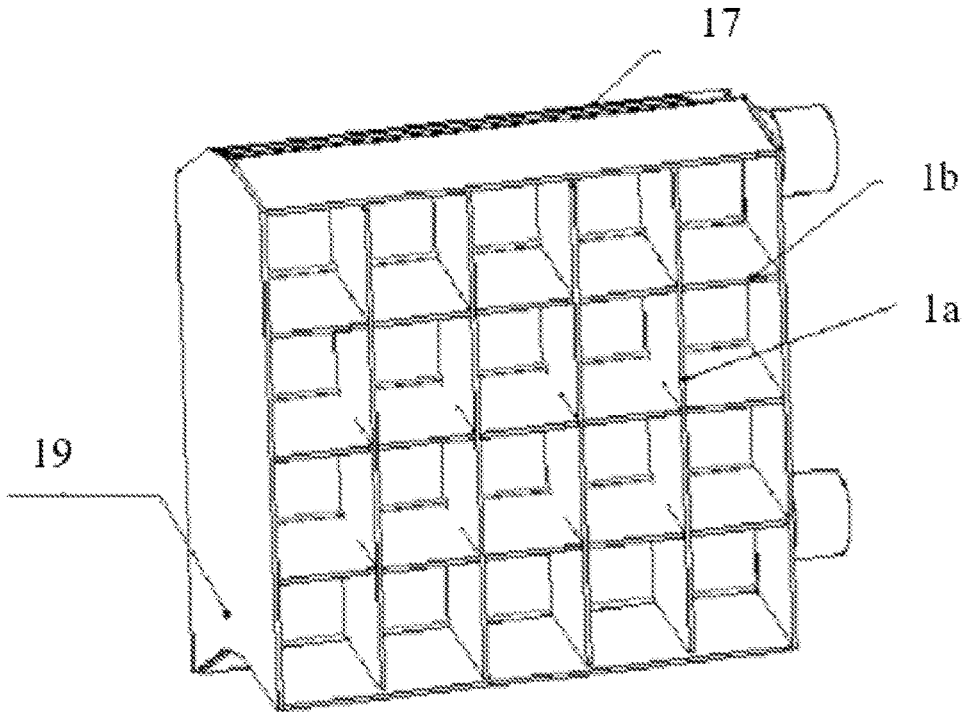
FIGS. 5 and 6 illustrate perspective views of the evaporator assembly employed in the vertical flow type ice making machine, in accordance with embodiments of the present disclosure.
Figure 6:
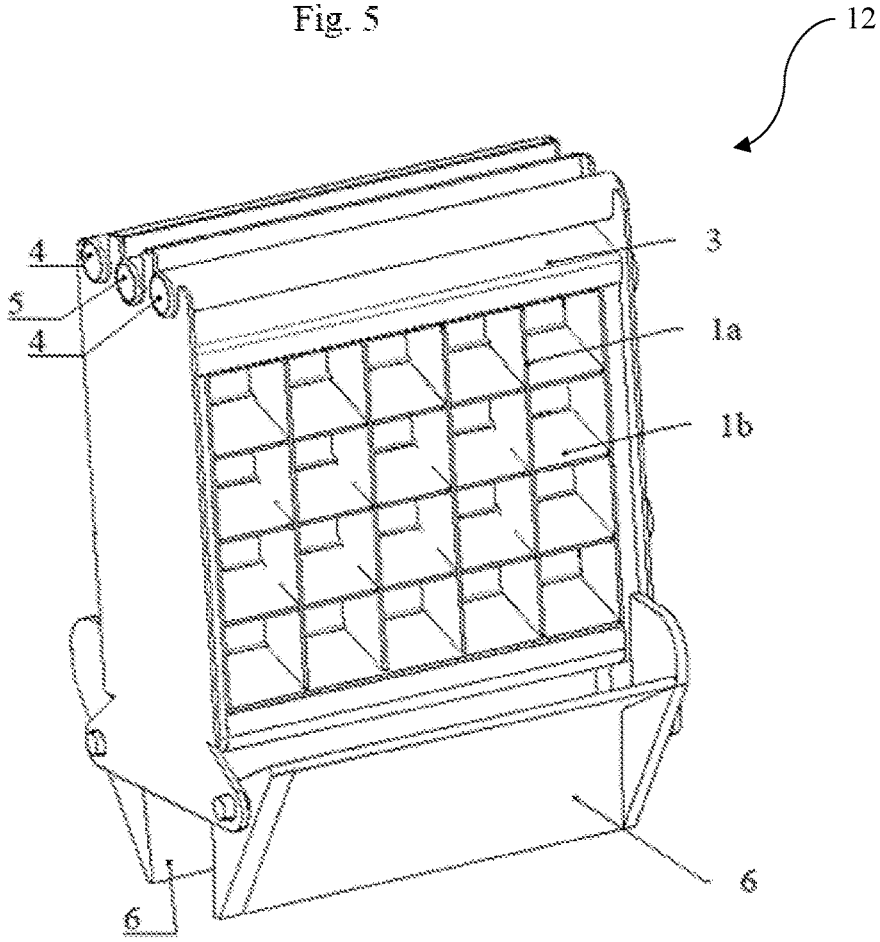

FIGS. 5 and 6 illustrate perspective views of the evaporator assembly (12). The vertical and the horizontal cooling surface (1*a* and 1*b*) form a plurality of ice forming blocks (A) on the first surface (15*a*) of the conductive walls (15). The ice forming blocks (A) or ice forming regions are open on one side whereas the other side of the ice forming blocks (A) are sealed as they lie in direct contact with the first surface (15*a*) of the conductive walls (15). Further, the plurality of channels (C) may be interconnected by connectors (14) which allows the continuous flow of refrigerant between the plurality of channels (C). The connectors (14) are depicted in the FIGS. 23 and 24. The refrigerant initially enters the top channel (C) and flows through all of the channels (C) by means of the connectors (14). The refrigerant further exits from the bottom channel (C). FIG. 5 discloses the cooling surfaces (1) arranged to form plurality of ice forming blocks (A) and all the surfaces disclosed in the FIG. 5 are conductive surfaces. In an embodiment, all the surfaces of disclosed in FIG. 5 are made of copper or any other highly heat conductive metal. Further, FIG. 6 illustrates the conductive surfaces of FIG. 5 being housed by a non-conductive frame (3). The non-conductive frame (3) may be of polymeric material. The fluid flow lines (4) and the defrost flow lines (5) housed on the frame may also be of non-conductive material. Further, the flap (6) provided at the bottom end may also be of non-conductive material.

Figure 7:
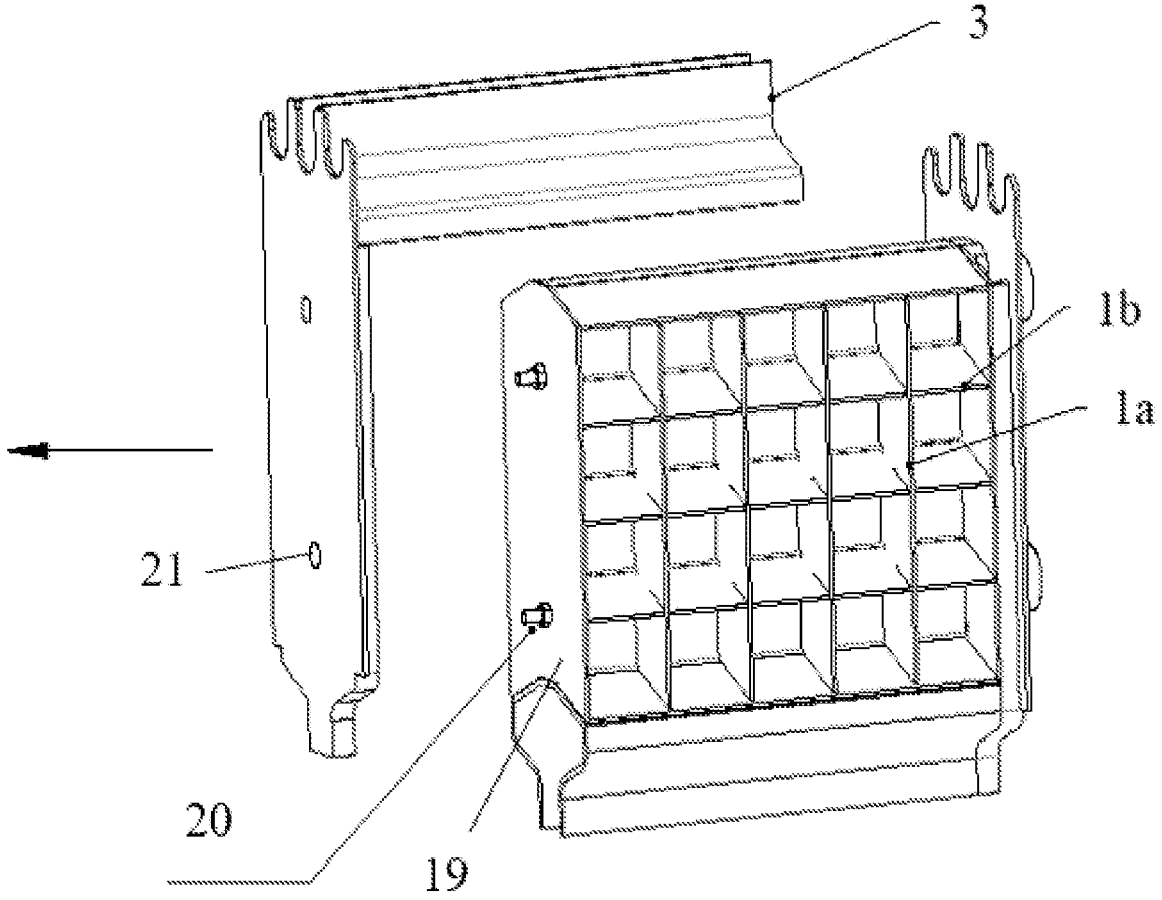
FIG. 7 illustrates an exploded perspective view of the evaporator assembly in of FIG. 6 with the non-conductive portions of the evaporator assembly being removed from the conductive portion of the evaporator assembly.

Further, FIG. 7 illustrates a perspective view of the evaporator assembly (12) with a disassembled frame (3). The plurality of horizontal and vertical cooling surfaces (1*b* and 1*a*) which are arranged to define the plurality of ice forming blocks may be enclosed by a plurality of side plates (19). Once, the plurality of ice forming blocks (A) are configured, the side plates (19) may be provided at either ends of the ice forming blocks (A). The side plates (19) may be configured parallel to the vertical cooling surfaces (1*a*). Further, at least one screw (20) may be provided with the side plate (19) and these screws (20) may be aligned with at least one provision (21) defined in the frame (3). The frame (3) may be easily and removably attached to the side plate (19) by means of the screws (20) and the provisions (21). The above configuration enables the user to easily disassemble the evaporator assembly (12) and thereby cleaning of the evaporator assembly (12) is made easier. Further, every component including the cooling surfaces (1*a* and 1*b*) of the evaporator assembly (12) can be disassembled. Consequently, cleaning each and every surface on the evaporator assembly (12) becomes easier and better hygienic standards can be maintained. The frame (3) is made of polymeric material due to which the formation of rust is completely avoided and the formation of bacterial in theses surfaces is also avoided. The evaporator assembly (12) does not comprise of any hidden surfaces and all the surfaces of the evaporator assembly (12) can be easily seen. Consequently, detecting any formation of impurities becomes easier and these impurities can be eliminated before the ice blocks (8) are formed. Further, the frame (3) including the side plates (19) and the cooling surfaces (1) can easily be disassembled for cleaning. In an embodiment, the frame (3) may be made of any suitable non-conductive material. The non-conductive materials including the fluid flow lines (4), defrost line (5) and the flaps (6) may be disassembled for cleaning.

Figure 8:
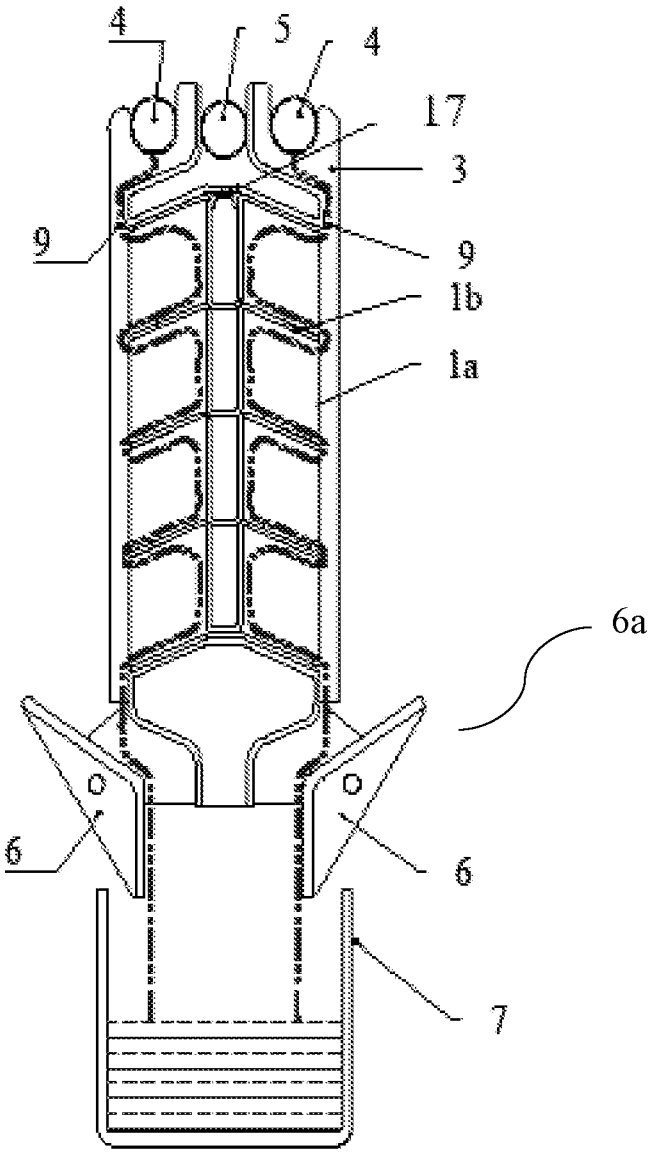
FIG. 8 illustrates a sectional side view of the evaporator assembly showing operation during cooling cycle, in accordance with an embodiment of the present disclosure.

FIG. 8 is a side view of the evaporator assembly (12) that shows the operation of the evaporator assembly (12) during a cooling cycle. Fluid i.e. water from the fluid tank (7) may be pumped into the plurality of water flow lines (4). The water from the water flow lines (4), flows onto the plurality of horizontal cooling surfaces (1*b*) through a plurality of apertures at the bottom of the water flow lines (4). The flow of water during the cooling cycle (9) is clearly seen from FIG. 8. Further, the water flows on the plurality of horizontal cooling surfaces (1*b*) and comes in direct contact with the first surface (15*a*) of conductive walls (15). Since, there exists a direct contact between the stream of water on the first surface (15*a*) of the conductive wall (15) and the refrigerant at the second surface (15*b*) of the conductive wall (15), the ice is formed at a faster rate. Also, the overall operational efficiency of the evaporator assembly (12) is increased since the first surface (15*a*) of the conductive wall (15) comes in direct contact with the flowing water. As seen from the FIG. 7, the water flow during the cooling cycle (9) is initially directed onto the plurality of cooling surface (1). The water further flows onto the first surface (15*a*) of the conductive walls (15) where the refrigerant flowing in the channels (C) absorbs the heat from the water and causes it to solidify on the first surface (1*b*) of the channel (C). The ice is thus directly formed on the surface of the conductive wall (15). Further, as additional water is circulated through the cooling surfaces (1) of the ice forming blocks (A), the water further solidifies on the already formed layer of ice on the first surface (15*a*) of the conductive wall (15). Thus, the ice is gradually formed in the form of layers inside the plurality of ice forming blocks (A). As the layers of ice that is formed inside the block (A) increases, the ice gradually takes the shape of the block (A). As seen from the FIG. 7, the water gradually flows through all the ice forming blocks (A) of the evaporator assembly (12). The water that is not frozen or solidified in the first block (A1) of the evaporator assembly (12), flows to the next or the second block (A2). Further, only a certain amount of water that flows in the second block (A2) solidifies, whereas the excessive water flows to the third block (A3) by means of the plurality of cooling surfaces (1). This flow of water continues through all the ice forming blocks (A) of the evaporator assembly (12). Any remaining water that is not frozen or solidified from the last block (A) of the evaporator assembly (12) flows into the fluid tank (7) that is housed below the evaporator assembly (12). The flap (6) remains in a first position (6*a*) and the excessive water travels on the surface of the flaps (6). The ice is gradually formed in a layer by layer manner inside all the ice forming blocks (A) of the evaporator assembly (12). Since the conductive walls (15) directly acts as the base surface for the formation of ice, the heat transfer between the water that flows on the first surface (15*a*) of the conductive walls (15) and the refrigerant flowing on the second surface (15*b*) is abundant. Therefore, the rate or the time required for the ice to be formed is drastically improved and the overall operational efficiency of the evaporator assembly (12) is also improved. Further, there exists no cooling loss as the ice is formed on first surface (15*a*) of the conductive wall (15) and the refrigerant flows on the second surface (15*b*) of the same wall (15).

Figure 9:
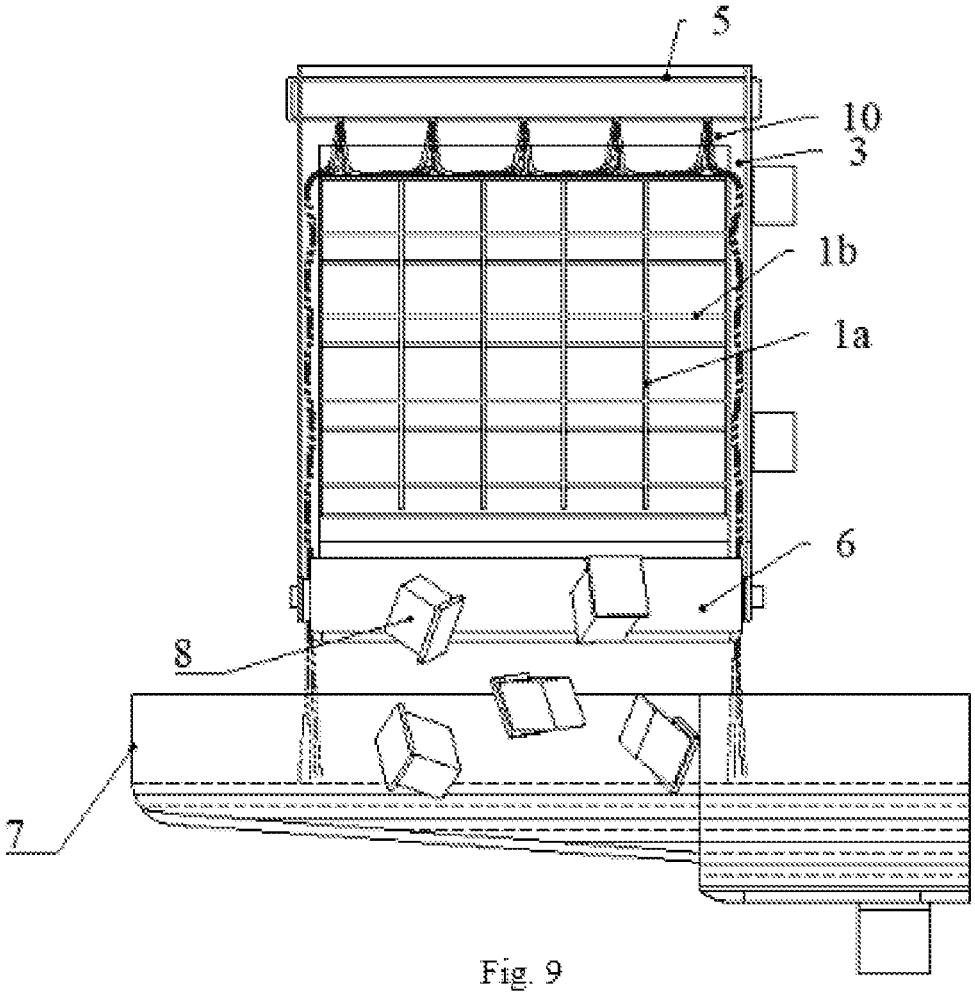
FIGS. 9 and 10 illustrate front views of the evaporator assembly showing operation during harvest cycle, in accordance with an embodiment of the present disclosure.
Figure 10:
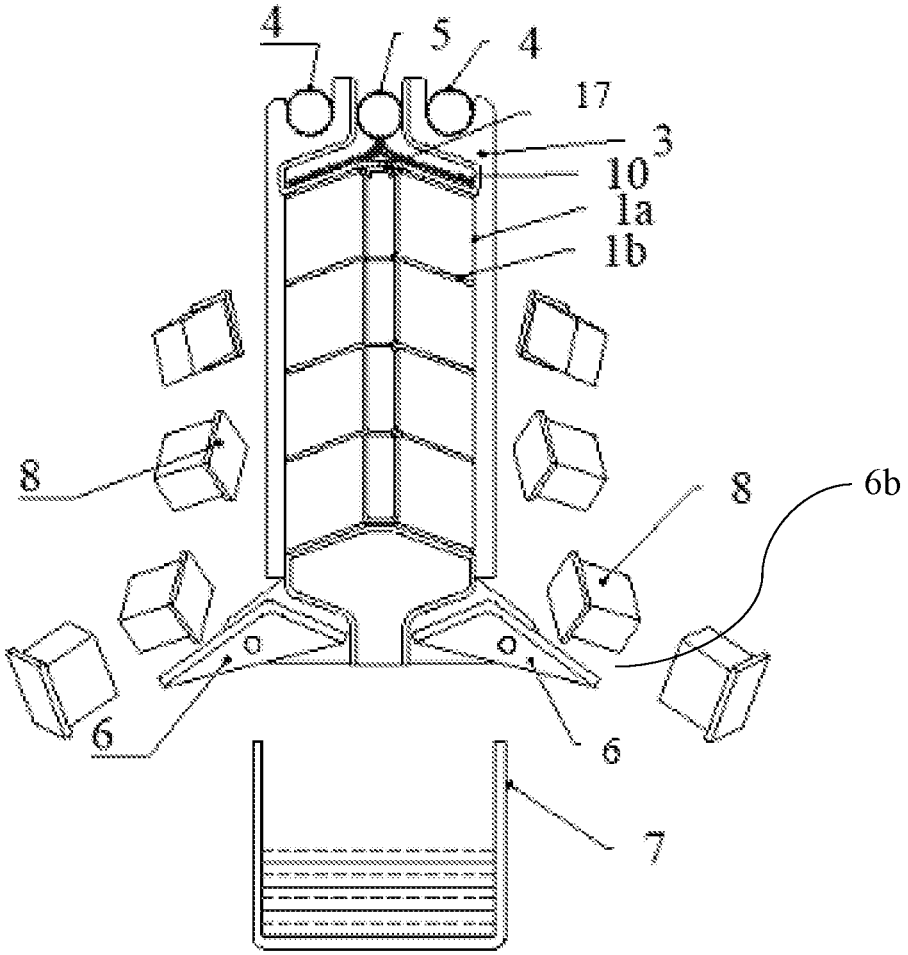

FIG. 9 and FIG. 10 is a front and side view of the evaporator assembly (12) that shows the flow of fluid during a harvest cycle (10). The defrost fluid supply tube (5) is provided on the top of the evaporator assembly (12). The defrost fluid is supplied to the defrost fluid tube (5) by means of a pump or any other suitable means from a defrost fluid tank. The defrost fluid may be hot water or any other suitable fluid. The defrost fluid which is generally at a higher temperature compared to the water that is circulated through the cooling surfaces (1), is sprayed by suitable means onto the plurality of conductive walls (15) of the channels (C). The defrost fluid is sprayed onto the plurality of conductive walls (15), only when the ice is completely formed inside all or most of the ice forming blocks (A). When the hot defrost fluid come in contact with the conductive walls (15), the overall temperature of the conductive walls (15) across the overall length of the channels (C) increases. This increase in temperature causes the ice that is formed on the first surface (15*a*) of the plurality of channels (C) to partially melt. As the ice partially melts from the first surface (15*a*) of the channel (C), the ice blocks (8) inside the plurality of ice forming blocks (A) get detached from the first surface (15*a*) of the plurality of conductive walls (15). The ice blocks (8) inside the ice forming blocks (A) that are now separated from the first surface (15*a*) of the conductive walls (15), gradually falls down onto the flap (6) as seen from the FIG. 8. The flap (6) pivots to a second position (6*b*) due to the weight of the falling ice blocks (8) and thereby the ice blocks (8) are directed away from the fluid tank (7) that is placed below the evaporator assembly (12) onto a different ice block storage container [not shown].

In an embodiment of the disclosure, the defrost fluid may be directly circulated through the plurality of channels (C) during the harvest cycle.

In an embodiment of the disclosure, coolant may be circulated through the channels (C), wherein the coolant may act as a refrigerant and a defrost fluid. The coolant initially cools the water flowing through the plurality of cooling surfaces (1) to form ice. Further, during the harvest cycle, the coolant may be externally heated by the defrost fluid spray which causes the ice blocks (8) to be detached from the plurality of ice forming blocks (A).

In an embodiment of the disclosure, the defrost fluid tube (5) may be provided with a plurality of sprays, wherein the heated defrost fluid may be sprayed throughout the overall length of the conductive walls (15).

In an embodiment of the disclosure, the cooling cycle and the harvest cycle may operate for a predetermined amount of time, wherein the predetermined amount of time may be the minimum time required for the ice to be formed during the cooling cycle and the minimum amount of time required for the ice to be detached from the first surface (15*a*) of the conductive walls (15) during the harvest cycle.

In an embodiment of the disclosure, a plurality of thermal sensors or an optical identification device, or an image capturing devices (E.g. Camera) may be provided on the evaporator assembly (12) to detect the formation of ice. Accordingly, when the sensors detect that the ice blocks (8) are ready to be harvested, the harvest cycle in the evaporator assembly (12) may be initiated.

Figure 11:
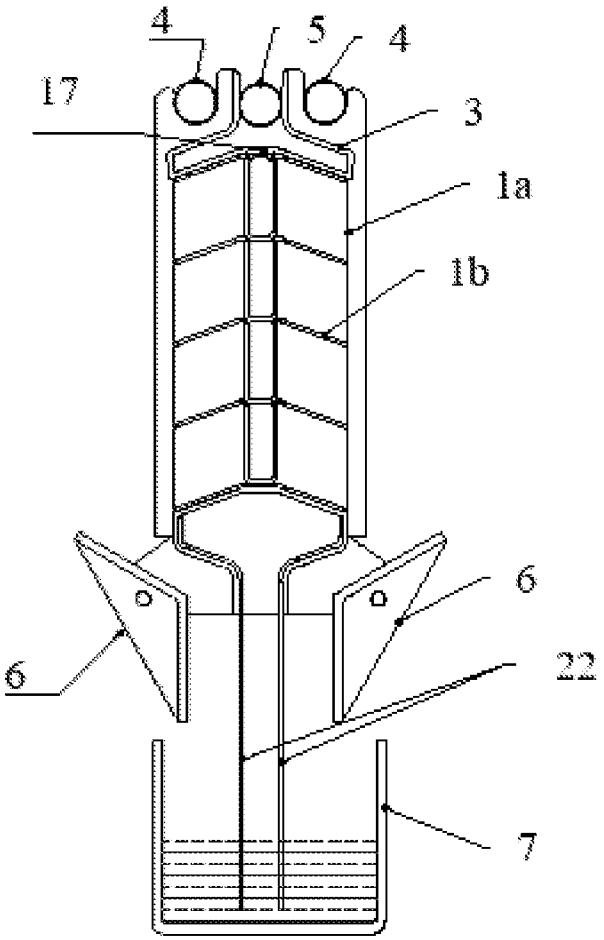
FIG. 11 illustrates a sectional side view of the evaporator assembly with conductive plates extending from the evaporator assembly to a reservoir, in accordance with an embodiment of the present disclosure.

FIG. 11 illustrates the side view of the evaporator assembly (12) with conductive strips (22). The conductive strips (22) may extend from the bottom channel (C) to the fluid inside reservoir (7). During the harvest cycle, as the defrost fluid is sprayed by the defrost fluid line (5), the excessive fluid seeps through the cooling surfaces (1*a* and 1*b*) and gets collected in the fluid tank (7). The fluid collected in the reservoir (7) during the harvest cycle is at significantly high temperatures. Further, as the defrost fluid is sprayed from the defrost fluid line (5), the channels (C) at the lower end of the evaporator assembly (12) often do not come in contact with sufficient amount of defrost fluid for the efficient separation of ice from the first surface (15*a*) of the conductive walls (15). The conductive strips (22) at the bottom end of the evaporator assembly (12) serve the purpose of conducting the heat from the hot fluid in the reservoir (7) to the conductive walls (15) at the bottom of the evaporator assembly (12). Consequently, the conductive strips (22) enable the effective separation of ice from the ice forming blocks (A) and the first surface (15*a*) of the conductive walls (15).

Figure 12:
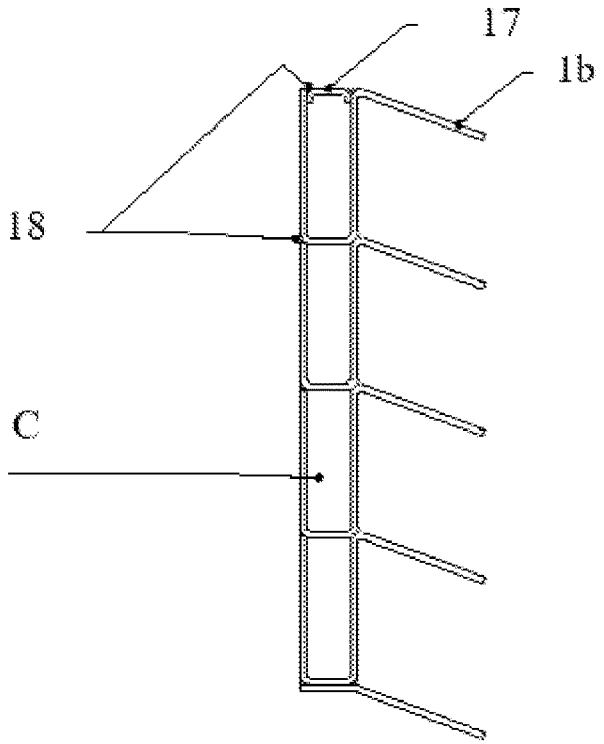
FIGS. 12 and 13 illustrate side view and perspective view of the evaporator assembly with ice forming blocks on single side, in accordance with an embodiment of the present disclosure.
Figure 13:
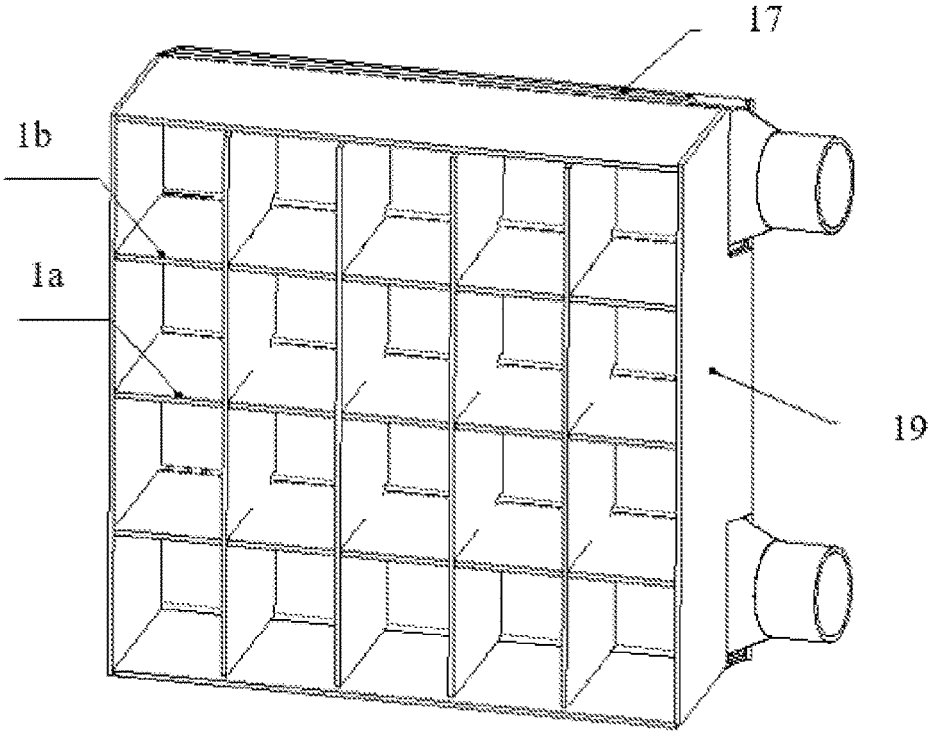

FIGS. 12 and 13 illustrates a side view and an isometric view of the evaporator assembly (12) respectively. In an embodiment of the disclosure, the horizontal and the vertical cooling surfaces (1*b* and 1*a*) may be configured on only one side of the conductive walls (15). The horizontal cooling surfaces (1*b*) may be directly attached to the top end of the plurality conductive walls (15) such that horizontal cooling surfaces (1*b*) are configured only along a single direction. Further, the horizontal cooling surfaces (1*b*) may be connected to either of the two parallel conductive walls (15) defining the channel (C).

In an embodiment of the disclosure, the horizontal cooling surfaces (1*b*) may be joined to the conductive walls (15) by fastening or other suitable means.

Figure 14:
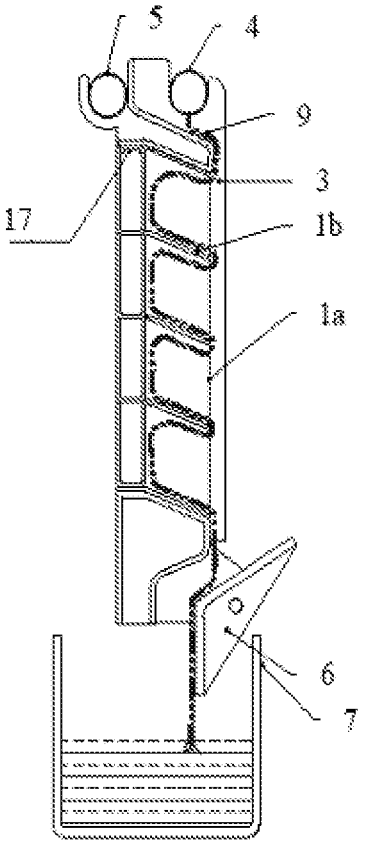
FIGS. 14 and 15 illustrate side views of the evaporator assembly with ice forming blocks on single side during cooling cycle and harvest cycle, in accordance with an embodiment of the present disclosure.
Figure 15:
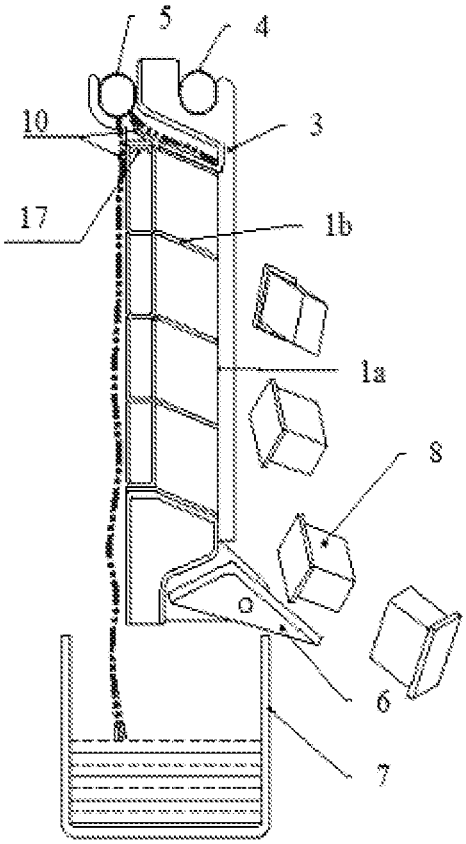

FIG. 14 and FIG. 15 illustrate side views of the evaporator assembly (12) with ice forming regions or block in one side, during cooling cycle and during harvest cycle, respectively. The defrost fluid line (5) may be provided behind the channels (C) such that the defrost fluid directly flows on the conductive walls (15) of the channels (C) during the harvest cycle. Further, the working of the evaporator assembly (12) in this embodiment is same as mentioned above.

Figure 16:
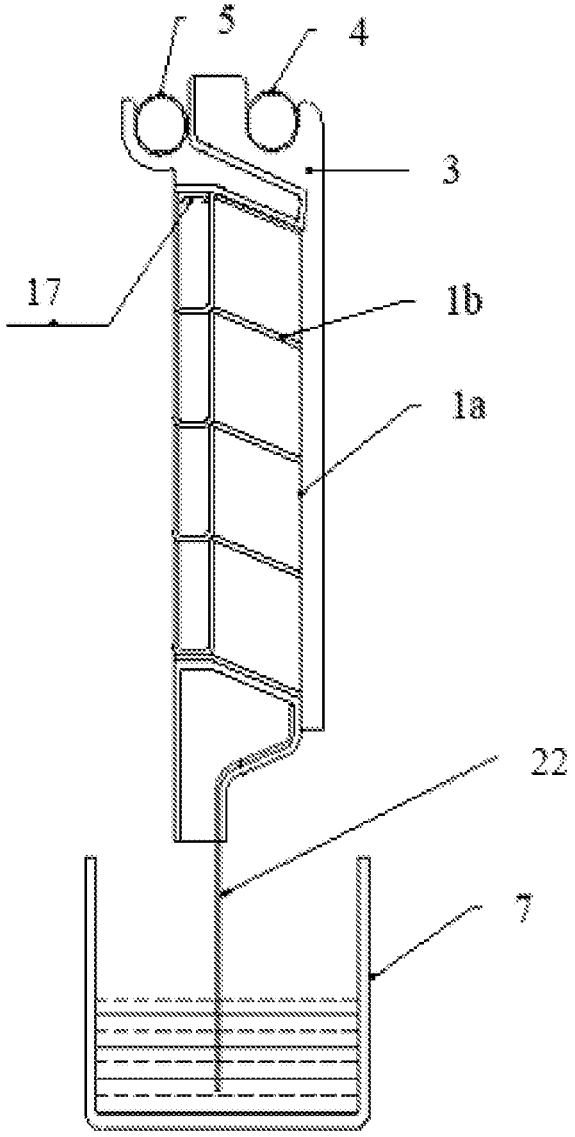
FIG. 16 illustrates a side view of the ice forming blocks on single side assembly configured with conductive strips, in accordance with an embodiment of the present disclosure.

Now referring to, FIG. 16 which illustrates a ice forming blocks on one side, configured with the conductive strips extending between the bottom channels (C) and the fluid in the reservoir (7). Further, the configuration and the working of conductive strips (22) is similar to the configuration and working disclosed in FIG. 11.

In an embodiment of the disclosure, the overall heat transfer between the conductive walls (15) and the fluid that is to be converted to ice is improved since the fluid comes in direct contact with the conductive walls (15).

Figure 17:
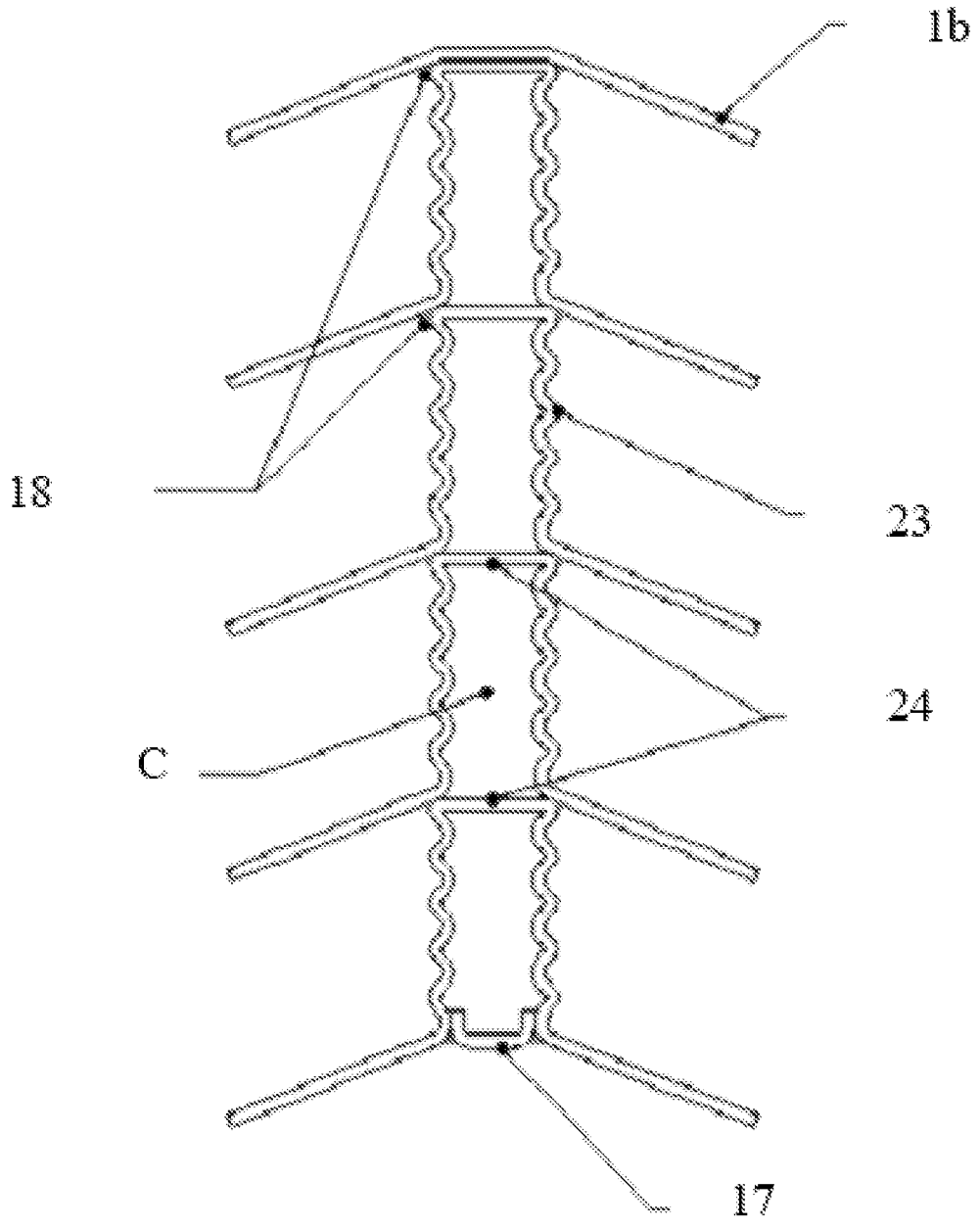
FIG. 17 illustrates schematic side view of an evaporator assembly employed in the ice making machine showing plurality of channels defined by parallel conductive walls which are arranged vertically and with curled vertical conductive walls, in accordance with an embodiment of the present disclosure.

FIG. 17 illustrates the side view of evaporator assembly (12) with curled vertical conductive walls (23). The first and the second surface (15*a* and 15*b*) of the vertical conductive walls (23) may be curled and the bottom or the horizontal conductive wall (24) connecting the two vertical conductive walls (15*a*) may be of a flat profile. The curled vertical conductive walls (23) increase the conductive area and thereby improve the rate at which the ice blocks (8) are formed.

In an embodiment of the disclosure, the rate at which the fluid converts to ice is improved and ice blocks (8) of required shape and size may be produced in a short span of time.

In an embodiment of the disclosure, the overall operational efficiency of the evaporator assembly (12) is improved by enabling the ice to be directly formed on the first surface (15*a*) of the conductive walls (15).

Figure 18:
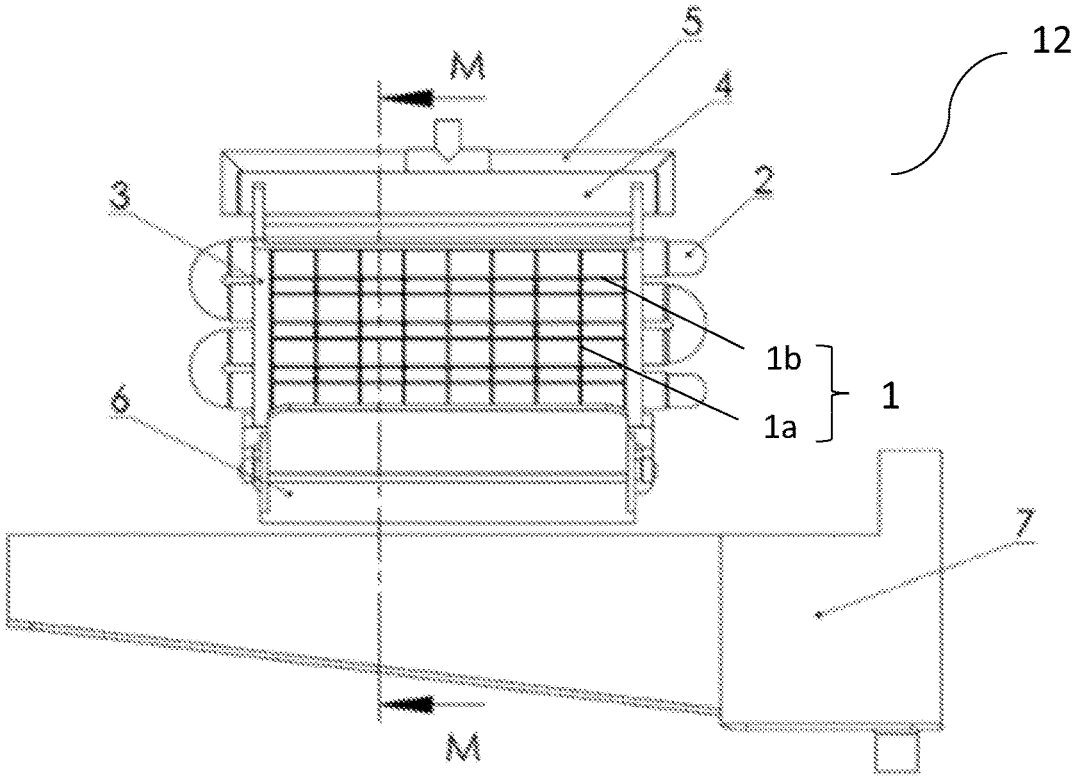
FIG. 18 illustrates a front view of an ice making machine, in accordance with an embodiment of the present disclosure.
Figure 19:
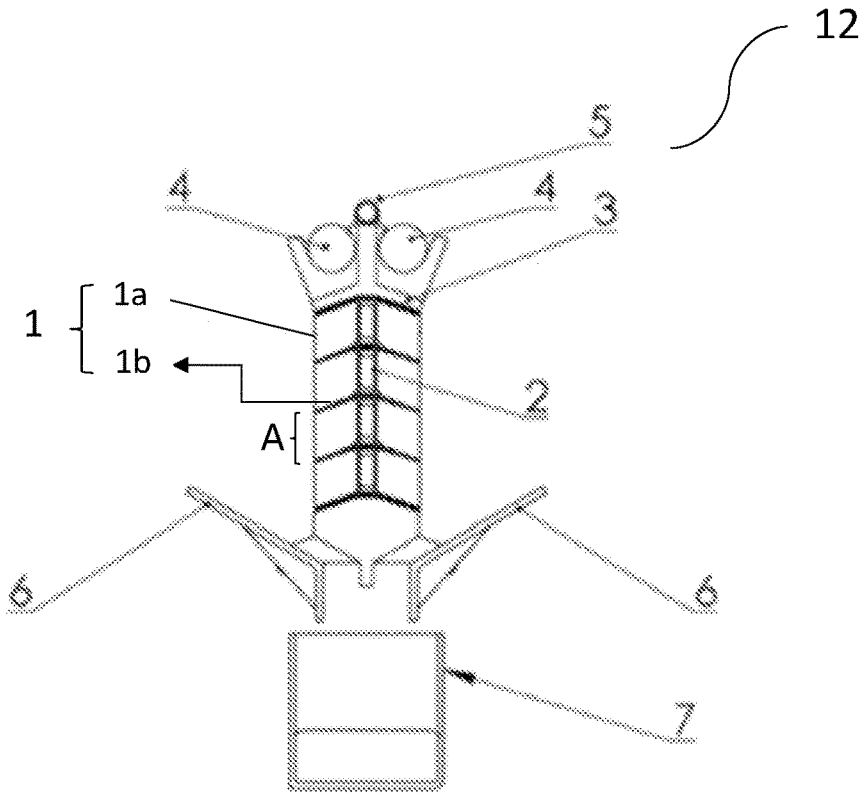
FIG. 19 illustrates a sectional side view of the ice making machine taken along axis M-M of FIG. 18, in accordance with an embodiment of the present disclosure.

Referring to FIG. 18 and FIG. 19 which illustrate a front view and side view of an ice making machine (11) in accordance with another embodiment of the present disclosure. The ice making machine (11) comprises of an evaporator assembly (12) and the evaporator assembly (12) comprises of an evaporator frame (3). The configuration of the evaporator frame (3) is similar to the configuration described above with reference to FIGS. 1 and 2. Further, the evaporator assembly is configured with vertical cooling surface (1*a*) and horizontal cooling surface (1*b*). The vertical and the horizontal cooling surfaces (1*a* and 1*b*) may form a rectangular or square shaped ice forming blocks (A). Further, the evaporator assembly (12) in accordance with this embodiment may be provided with a plurality of rectangular tubes (2). Theses rectangular tubes (2) enable the flow of refrigerant and are further referred to as refrigerant tubes (2). The refrigerant tubes (2) are defined by two vertical and two horizontal conductive wall (15). The outer surface of refrigerant tubes (2) may be the first surface (15*a*) of the conductive wall (15) and the first surface may house the plurality of cooling surfaces (1). Further, the inner surface of the refrigerant tube (2) may be the second surface (15*b*) of the conductive wall (15) and the second surface (15*b*) comes in contact with the refrigerant flowing through the tube. The refrigerant tube (2) which is of the rectangular cross-section may be configured such that the second surfaces (15*b*) of the vertical conductive walls (15) are opposite to each other. Further, the horizontal and the vertical cooling surfaces (1*a* and 1*b*) are configured to define a plurality of ice forming blocks (A). The refrigerant tubes (2) may be positioned behind the plurality of ice forming blocks (A) of the evaporator frame (3) and one end of each of the plurality of block (A) remains open whereas the other end of the ice forming blocks (A) are sealed by the plurality of refrigerant tubes (2).

Figure 20:
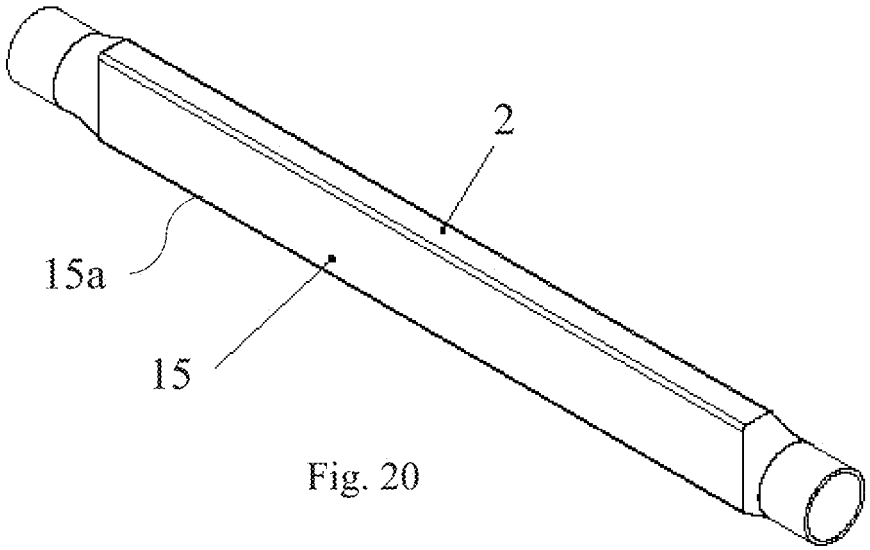
FIG. 20 illustrates an isometric view of the refrigerant tube used in the evaporator assembly, in accordance with an embodiment of the present disclosure.
Figure 21:
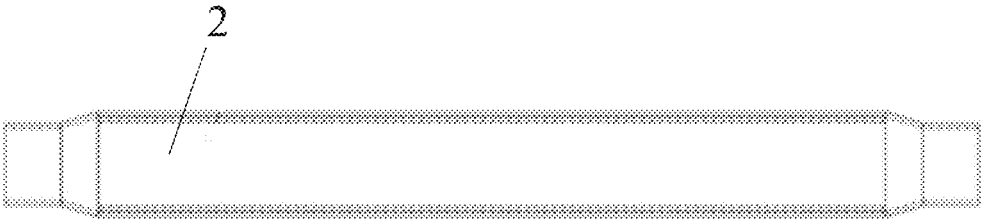
FIG. 21 illustrates a front view of the refrigerant tube used in the evaporator assembly, in accordance with an embodiment of the present disclosure.

FIGS. 20 and 21 show an isometric and front views of the refrigerant tube (2) respectively. As seen from the FIGS. 20 and 21, the refrigerant tube (2) may comprise of an elongated rectangular section and two circular sections at either ends of the elongated rectangular section. As seen from the FIG. 24, the refrigerant may initially enter either of the circular openings and flows through the elongated rectangular section before exiting the refrigerant tube (2) through another circular section. Further the rectangular section and the flat surface of the conductive walls (15) of the plurality of refrigerant tubes (2) enable the plurality of cooling surface (1) to be directly configured on the surface of the conductive walls (15) of the plurality of refrigerant tubes (2) to form a plurality of ice forming blocks (A). Further, as mentioned above in the description of FIG. 18, the outer surface of refrigerant tubes (2) may be the first surface (15*a*) of the conductive wall (15) and the first surface may house the plurality of cooling surfaces (1). Furthermore, the inner surface of the refrigerant tube (2) may be the second surface (15*b*) of the conductive wall (15) and the second surface (15*b*) comes in contact with the refrigerant flowing through the tube.

In an embodiment of the disclosure, the inner surface of the plurality of refrigerant tubes (2) may be internally finned for increasing the rate of heat transfer between the refrigerant tube and the water that comes in contact with the plurality of refrigerant tubes (2).

In an embodiment of the disclosure, the first surface (15*a*) of the conductive wall (15) of the plurality of refrigerant tubes (2) may be stamped with indentations of various shapes such that the ice formed on the plurality of refrigerant tubes (2) takes the shape or the pattern that has been depressed onto the refrigerant tubes (2).

Figure 22:
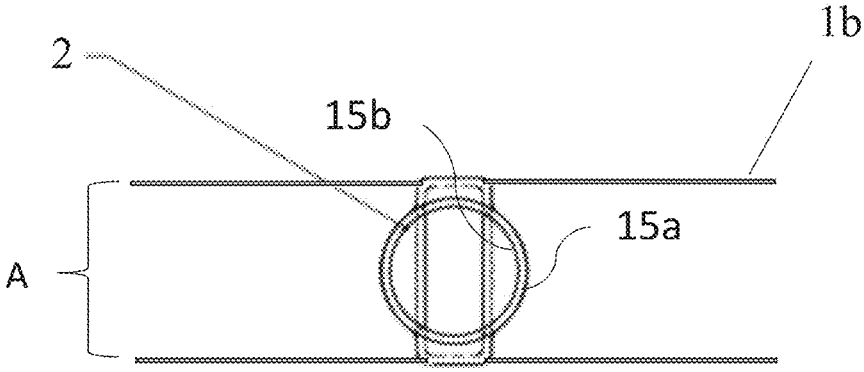
FIG. 22 illustrates a side view of the refrigerant tube with a plurality of copper plates, in accordance with an embodiment of the present disclosure.
Figure 23:
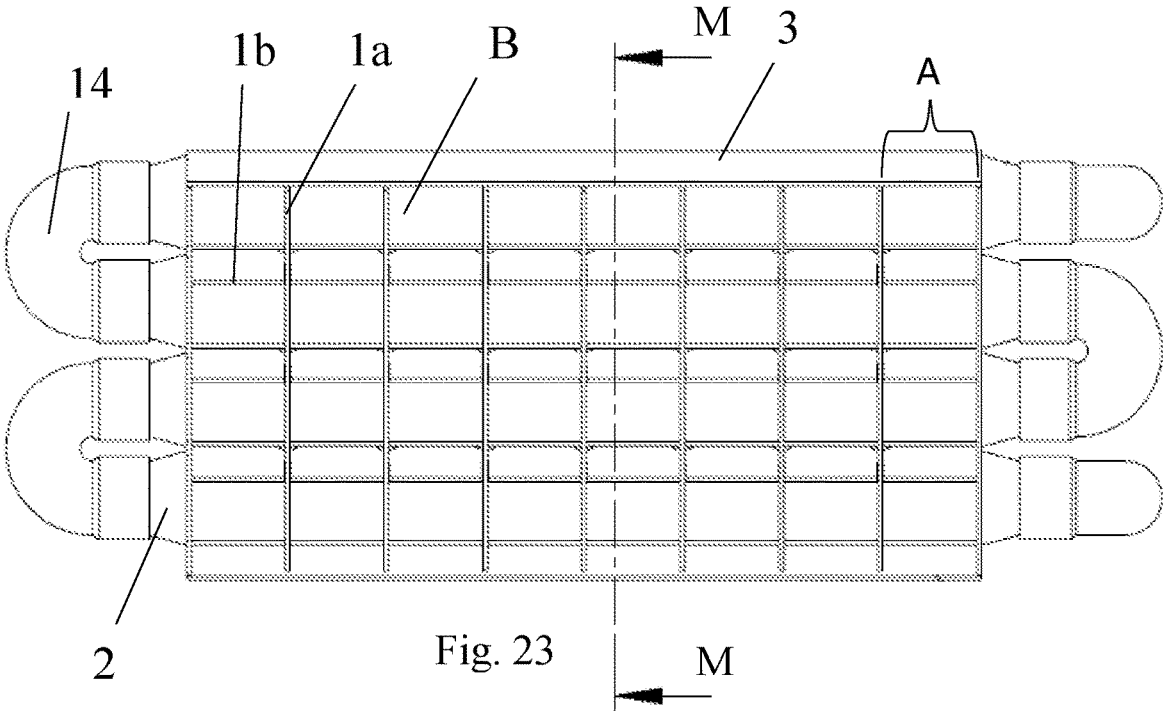
FIG. 23 illustrates a front view of the evaporator assembly, in accordance with an embodiment of the present disclosure.
Figure 24:
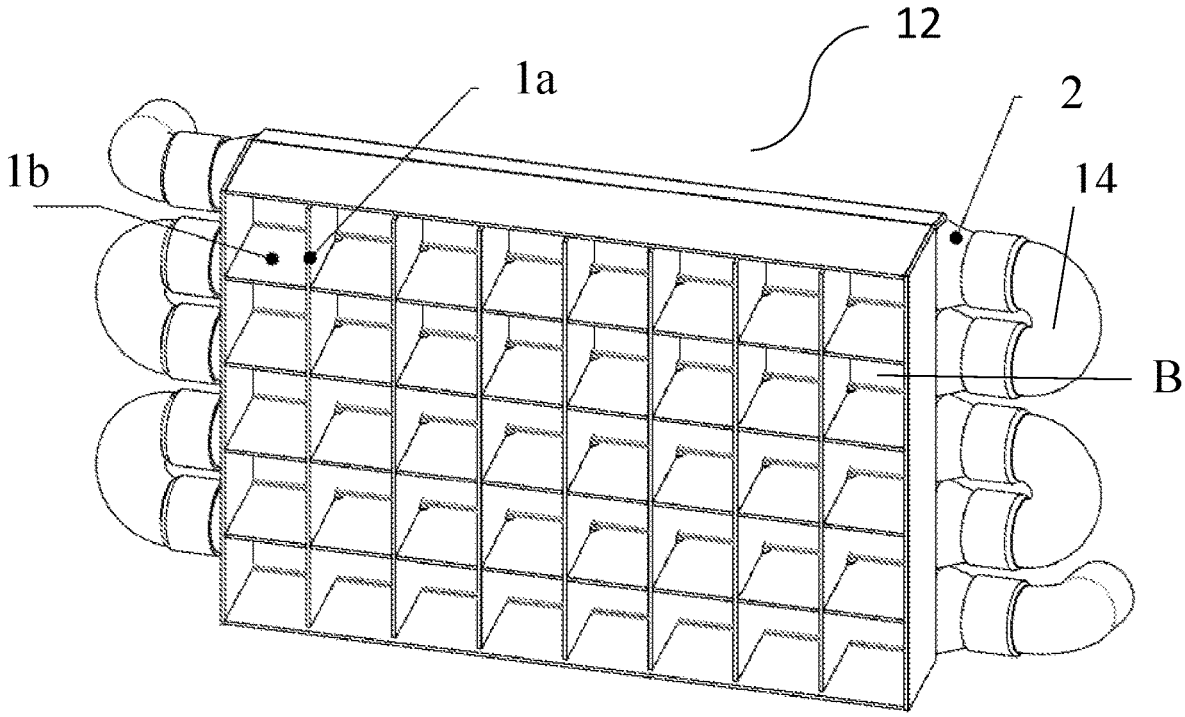
FIG. 24 illustrates an isometric view of the evaporator assembly, in accordance with an embodiment of the present disclosure.
Figure 25:
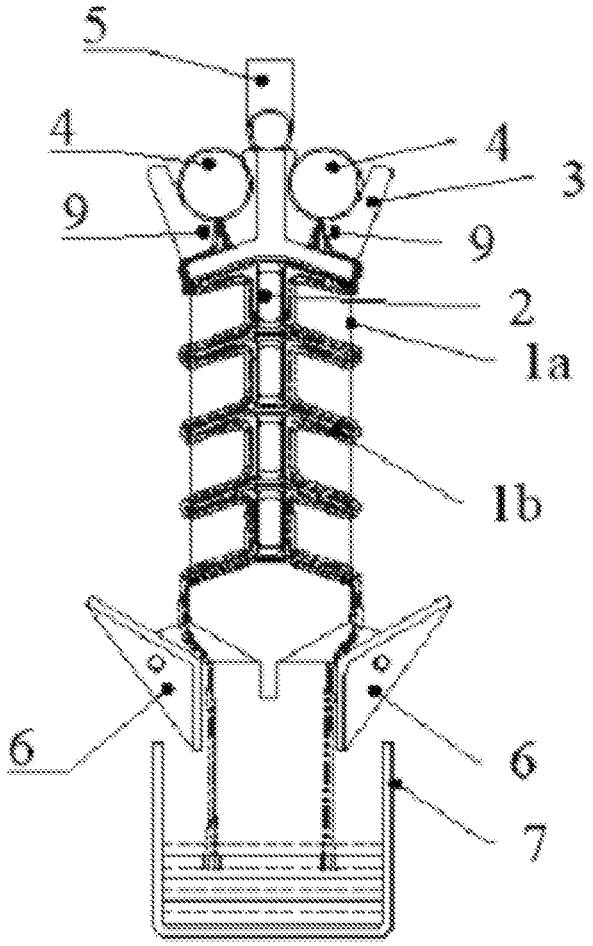
FIG. 25 illustrates a sectional side view of the evaporator assembly that shows operation during cooling cycle, in accordance with another embodiment of the present disclosure.
Figure 26:
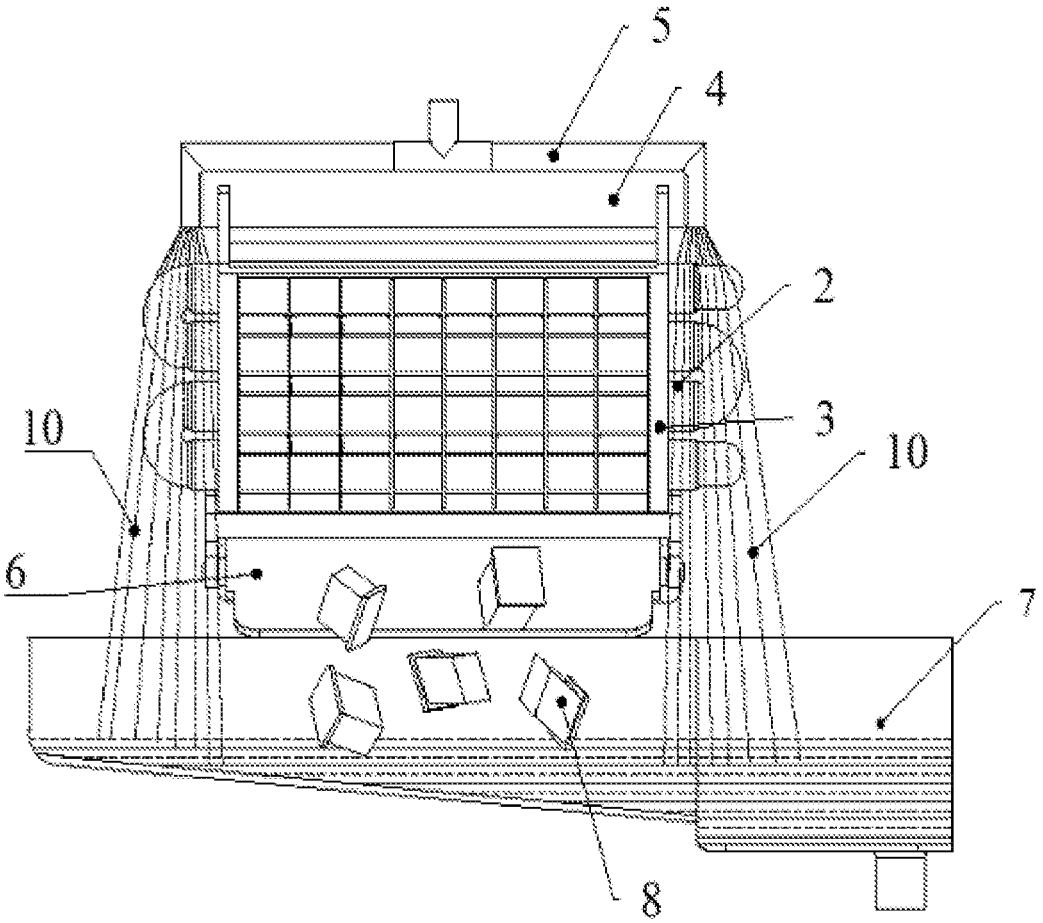
FIG. 26 illustrates a front view of the evaporator assembly that shows operation during harvest cycle, in accordance with an embodiment of the present disclosure.

In an embodiment, as seen in FIG. 22, a plurality of horizontal cooling surfaces (1*b*) may be directly joined by thermal joining process such as but nor limiting to soldering onto the top and bottom surfaces of the plurality of refrigerant tubes (2). The plurality of horizontal copper plates (1*b*) that are soldered (18) on to the refrigerant tubes (2) act as the cooling surface (1) and may also be soldered (18) such that a plurality of ice forming blocks (A) are formed on the plurality of refrigerant tubes (2)

Further, FIGS. 23 to 26 illustrate the configuration and the working of the evaporator assembly (12) and are similar to the configuration and working described above in the FIGS. 5 to 10.

Figure 27:
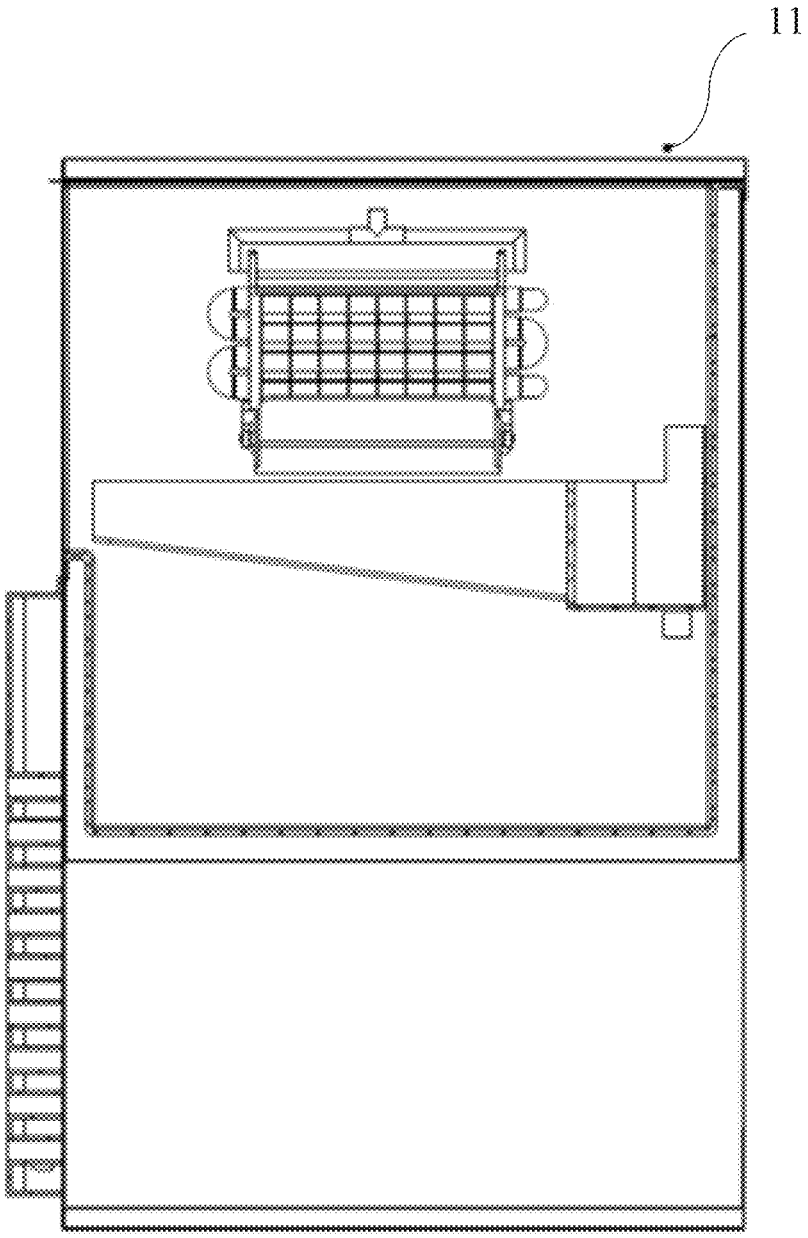
FIG. 27 illustrates a front view of the ice making assembly with the evaporator assembly, in accordance with an embodiment of the present disclosure.

FIG. 27 illustrates a front view of the ice making machine (11) with the evaporator assembly (12). In an embodiment of the disclosure, the evaporator assembly (12) along with the fluid tank (7) may be provided in an ice making machine (11). The ice blocks (8) that are formed by the evaporator assembly (12) may be acquired form a container inside the ice making machine (11).

Figure 28:
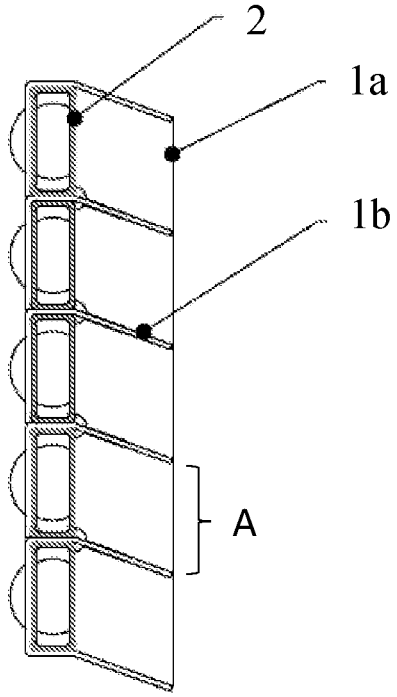
FIG. 28 illustrates schematic side view of the evaporator assembly employed in the ice making machine showing plurality of refrigerant tubes with ice forming blocks on single side, in accordance with an embodiment of the present disclosure.
Figure 29:
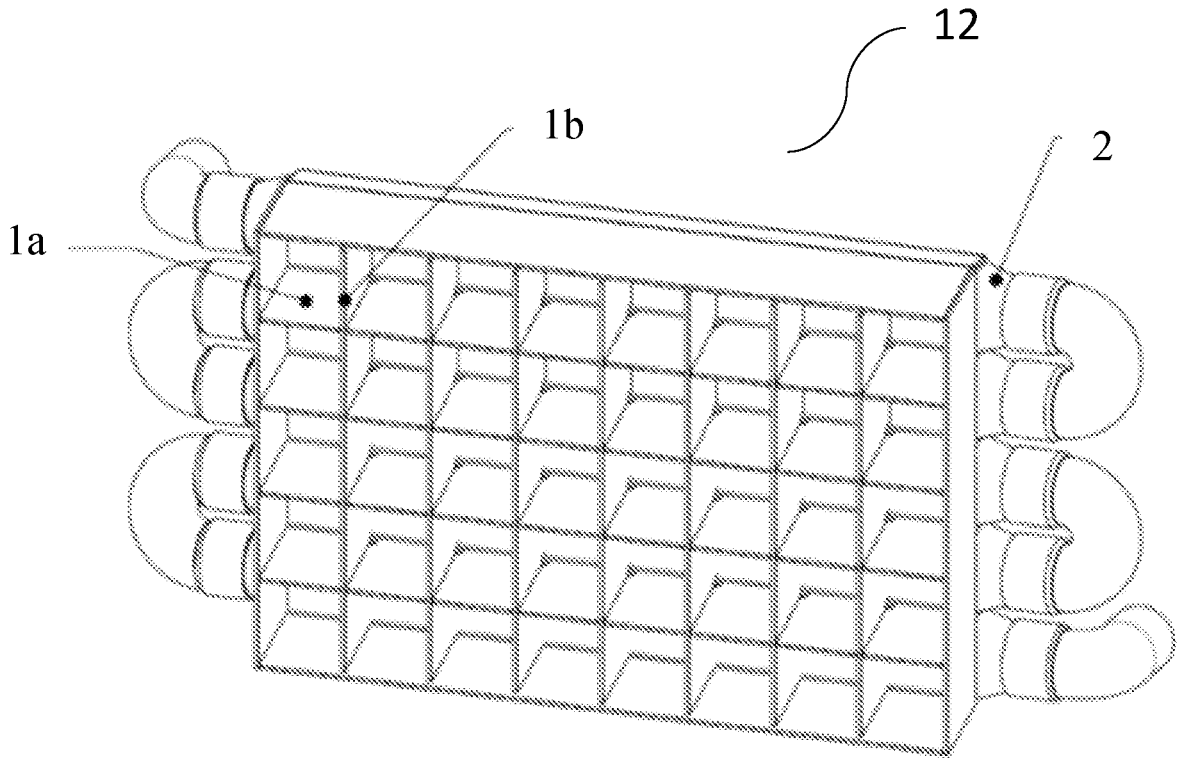
FIG. 29 illustrates an isometric view of the evaporator assembly with ice forming blocks on single side, in accordance with an embodiment of the present disclosure.
Figure 30:
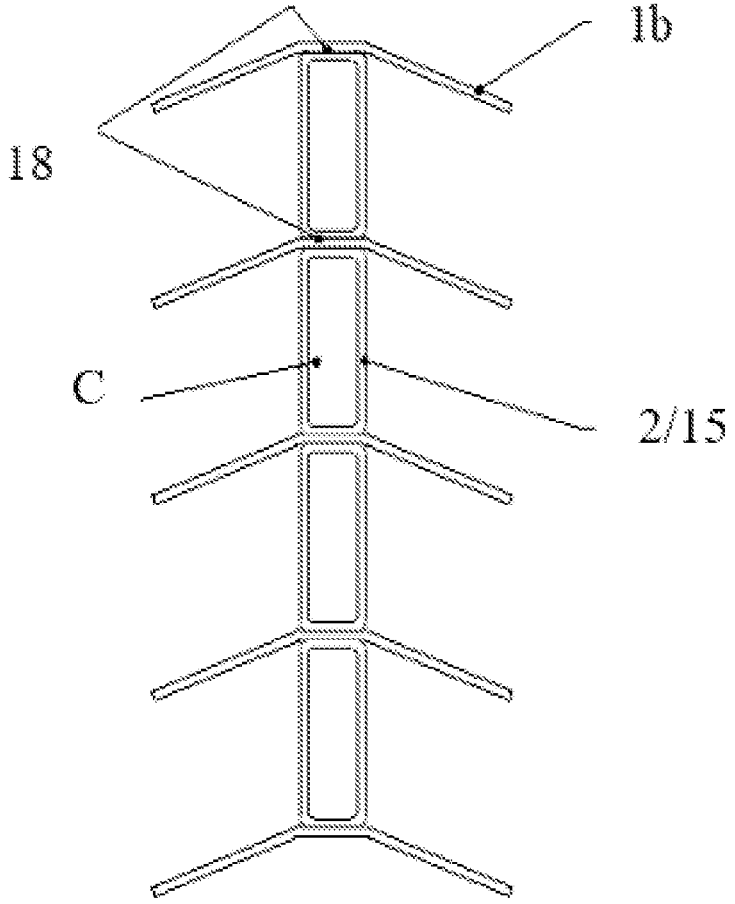
FIG. 30 illustrates a side view of the evaporator assembly, in accordance with an embodiment of the present disclosure.
Figure 31:
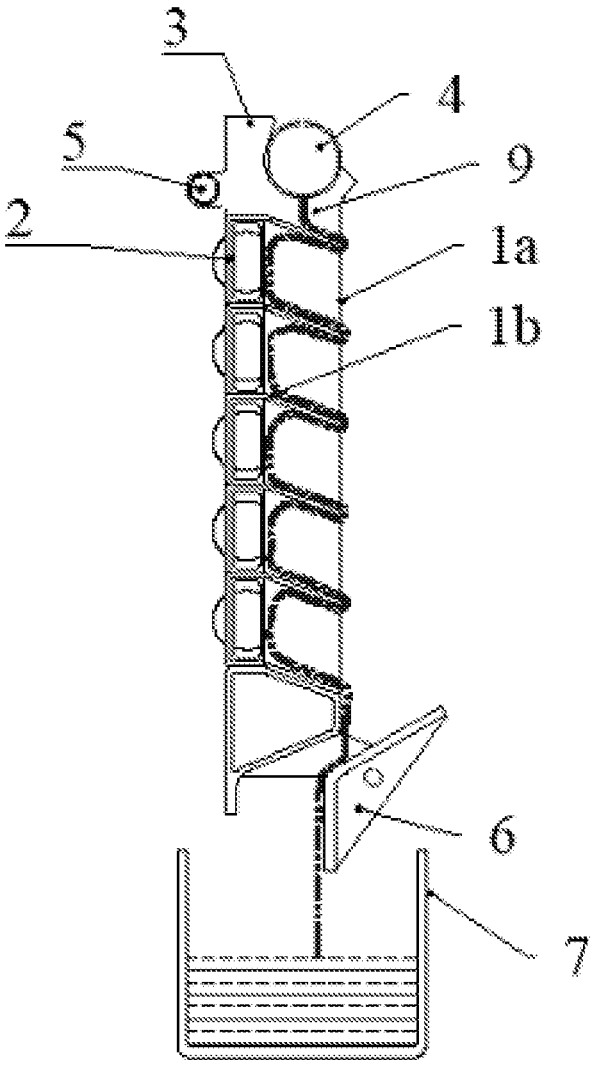
FIG. 31 illustrates a side view of the evaporator assembly with ice forming blocks on single side in operation during cooling cycle, in accordance with an embodiment of the present disclosure.
Figure 32:
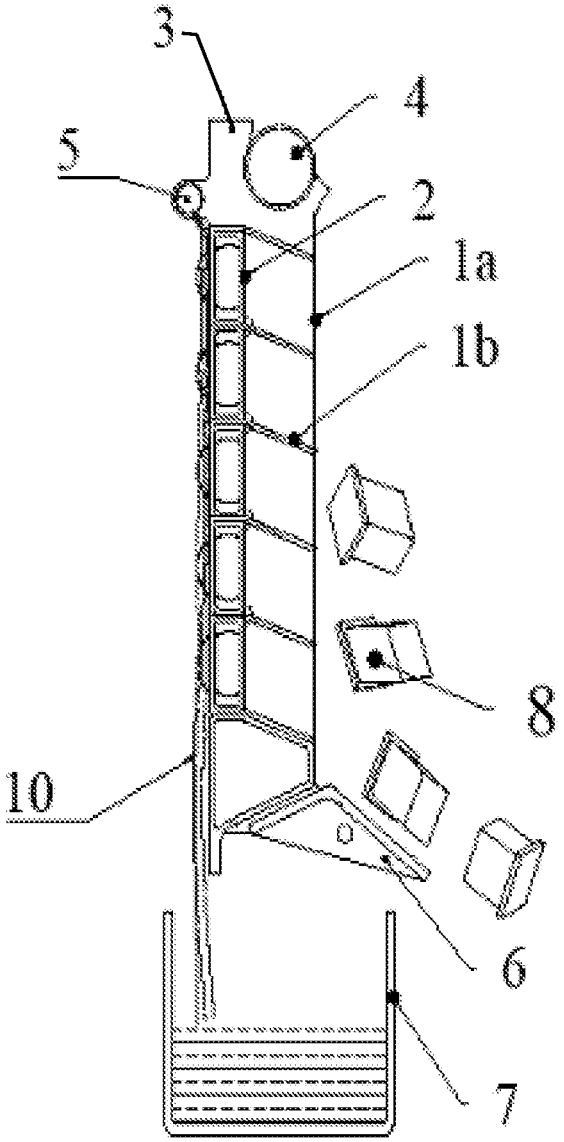
FIG. 32 illustrates a side view of the evaporator assembly with ice forming blocks on single side in operation during harvest cycle, in accordance with an embodiment of the present disclosure.

FIGS. 28 to 32 illustrates the evaporator assembly (12) with a single evaporator. The configuration and the working of the evaporator assembly (12) is similar to the configuration and working disclosed in the FIGS. 12 to 18 as mentioned above. In an embodiment of the disclosure, the horizontal and the vertical cooling surfaces (1*b* and 1*a*) may be configured on only one side of the refrigerant tubes (2). The horizontal cooling surfaces (1*b*) may be directly attached to the refrigerant tubes (2), where one end of the horizontal cooling surface (1*b*) extends behind the refrigerant tube (2) and the other end of the horizontal cooling surface (1*b*) extends at an angle to form multiple ice forming blocks (A) as seen in FIG. 28.

In an embodiment of the disclosure, the overall heat transfer between the conductive walls (15) defining the channel (C) and the fluid that is to be converted to ice is improved since the fluid comes in direct contact with the conductive walls (15).

In an embodiment of the disclosure, the rate at which the fluid converts to ice is improved and ice blocks (8) of required shape and size may be produced in a short span of time.

In an embodiment of the disclosure, the overall operational efficiency of the evaporator assembly (12) is improved by enabling the ice to be directly formed on the conductive wall (15). The ice is formed on first surface (15*a*) of the wall (15) and the refrigerant flows on the second surface (15*b*) of the same wall (15). Since, there are no additional surfaces between the refrigerant and the ice forming surface, the operational efficiency is improved as the ice forms at a quicker rate. Consequently, there no heat loss as the ice is formed on the same wall (15) on which the refrigerant flow.

In an embodiment, the disassembling and cleaning of the evaporator assembly (12) is easy due to the configuration of the side plates (19) and the frame (3) in the evaporator assembly (12).

EQUIVALENTS

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding the description may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated in the description.

TABLE of Referral Numerals:

| Referral numeral | Description |
|---|---|
| 1 | Cooling surface |
| 1a | Vertical cooling surfaces |
| 1b | Horizontal cooling surfaces |
| 2 | Rectangular/refrigerant tubes |
| 3 | Evaporator frame |
| 4 | Fluid flow line |
| 5 | Defrost fluid tube |
| 6 | Flap |
| 7 | Fluid tank |
| 8 | Ice blocks |
| 9 | Water flow during cooling cycle |
| 10 | Water flow during harvest cycle |
| 11 | Ice making machine |
| 12 | Evaporator assembly |
| 14 | Connectors for the refrigerant tube |
| 15 | Conductive wall |
| 16 | Slots in the horizontal cooling surface |

TABLE of Referral Numerals:-continued

| Referral numeral | Description |
|---|---|
| 17 | Cap |
| 18 | Soldered joints |
| 19 | Side plate |
| 20 | Screw |
| 21 | Provision on the side plate |
| 22 | Conductive strips |
| A | Ice forming blocks |
| B | Refrigerant tube surface |
| A1 | First block |
| A2 | Second block |
| C | Channel |

We claim:

1. An evaporator assembly for a vertical flow type ice making machine, the evaporator assembly comprising:

a frame;

a plurality of vertical cooling surfaces, each spaced at a distance and extending in a first direction within the frame;

a plurality of horizontal cooling surfaces, each spaced at a distance and extending in a second direction perpendicular to the first direction within the frame, wherein, an intersection of the plurality of vertical and horizontal cooling surfaces defines a plurality of ice forming blocks;

a plurality of shaped metallic sheets vertically stacked one above the other, each shaped metallic sheet of the plurality of shaped metallic sheets comprising a conductive wall extending vertically, the conductive wall including a first surface extending vertically and a second surface extending vertically, the first surface and the second surface forming opposite sides of the conductive wall, a horizontal cooling surface of the plurality of horizontal cooling surfaces, the horizontal cooling surface including a plurality of slots for accommodating the plurality of vertical cooling surfaces, and a first bend joining a vertical end of the conductive wall and a horizontal end of the horizontal cooling surface, wherein the first surfaces of the conductive walls are configured to accommodate the plurality of ice forming blocks and the second surfaces of the conductive walls are configured to come in contact with at least one of refrigerant and defrost fluid, and wherein the second surface of each of the conductive walls defines a channel of a plurality of channels, wherein each of the plurality of channels are configured vertically one above the other; and at least a fluid tank and one conductive strip extending from a plurality of channels to the fluid in the fluid tank provided below the evaporator assembly.

2. The evaporator assembly as claimed in claim 1, wherein each shaped metallic sheet of the plurality of shaped metallic sheets further comprises a second conductive wall including another first surface extending vertically and another second surface extending vertically, the another first surface and the another second surface forming opposite sides of the second conductive wall, wherein the second surface and the another second surface of each shaped metallic sheet face each other and form a channel of the plurality of channels that corresponds to the shaped metallic sheet.

3. The evaporator assembly as claimed in claim 2, wherein the plurality of channels is defined by a plurality of rectangular tubes positioned one above the other.

4. The evaporator assembly as claimed in claim 2, wherein the conductive wall and the second conductive wall of each shaped metallic sheet are parallel to one another.

5. The evaporator assembly as claimed in claim 1, wherein the frame is made of a polymeric material.

6. The evaporator assembly as claimed in claim 1, wherein the first directions is a vertical direction, and the second directions is a horizontal direction.

7. The evaporator assembly as claimed in claim 1, wherein the vertical end of each conductive wall is a top end.

8. The evaporator assembly as claimed in claim 1 comprising at least one pivotable flap connected to the frame.

9. The evaporator assembly as claimed in claim 1, wherein the frame houses at least one water flow line and at least one defrost fluid spray line.

10. The evaporator assembly as claimed in claim 1, comprising at least one side plate arranged parallel to the plurality of vertical cooling surfaces and is configured to enclose the plurality of ice forming blocks.

11. The evaporator assembly as claimed in claim 1, wherein the conductive walls are of a curled profile.

12. The evaporator assembly as claimed in claim 2, wherein each shaped metallic sheet of the plurality of shaped metallic sheets further comprises:

a horizontal channel portion having a first end and a second end;

a second bend joining the first end of the horizontal channel portion to the conductive wall of the shaped metallic sheet;

a third bend joining the second end of the horizontal channel portion to the second conductive wall of the shaped metallic sheet, wherein the horizontal channel portion, the second surface, and the another second surface of the shaped metallic sheet form the channel of the plurality of channels that corresponds to the shaped metallic sheet.

13. The evaporator assembly as claimed in claim 12, further comprising:

a second plurality of vertical cooling surfaces, each spaced and extending in the first direction within the frame;

a second plurality of horizontal cooling surfaces, each spaced and extending in the second direction perpendicular to the first direction within the frame;

wherein, an intersection of the second plurality of vertical and horizontal cooling surfaces defines a second plurality of ice forming blocks, and wherein each shaped metallic sheet further comprises:

a second horizontal cooling surface of the second plurality of horizontal cooling surfaces, the second horizontal cooling surface including a second plurality of slots for accommodating the second plurality of vertical cooling surfaces, and a fourth bend joining a vertical end of the second conductive wall of the shaped metallic sheet and a horizontal end of the second horizontal cooling surface of the shaped metallic sheet.

14. The evaporator assembly as claimed in claim 12, wherein a first channel of the plurality of channels corresponds to a first shaped metallic sheet of the plurality of shaped metallic sheets and is defined by:

the horizontal channel portion of a second shaped metallic sheet of the plurality of shaped metallic sheets, and the horizontal channel portion, the second surface, and the another second surface of the first shaped metallic sheet.

15. The evaporator assembly as claimed in claim 1, wherein each of the plurality of channels has a height extending vertically that is larger than a width extending horizontally.

16. The evaporator assembly as claimed in claim 1, wherein, for each conductive wall, the first surface of the conductive wall and the second surface of the conductive wall have a substantially same vertical height.

17. The evaporator assembly as claimed in claim 1, wherein, for each conductive wall, the first surface of the conductive wall and the second surface of the conductive wall have a substantially same surface area.

18. The evaporator assembly as claimed in claim 1, wherein, for each conductive wall, an angle of the first bend joining the vertical end of the conductive wall and the horizontal end of the horizontal cooling surface is less than 90 degrees such that the horizontal cooling surface is sloped downward away from the conductive wall.

19. A vertical flow type ice making machine, the machine comprising:

one or more evaporator assemblies, each of the one or more evaporator assemblies comprising:

a frame;

a plurality of vertical cooling surfaces, each spaced at a distance and extending in a first direction within the frame;

a plurality of horizontal cooling surfaces, each spaced at a distance and extending in a second direction perpendicular to the first direction within the frame, wherein, an intersection of the plurality of first and second cooling surfaces defines a plurality of ice forming blocks;

at least one fluid flow line positioned on an upstream side of each of the one or more evaporator assemblies for supplying liquid onto the plurality of ice forming blocks;

a plurality of shaped metallic sheets vertically stacked one above the other, each shaped metallic sheet of the plurality of shaped metallic sheets comprising a conductive wall extending vertically, the conductive wall including a first surface extending vertically and a second surface extending vertically, the first surface and the second surface forming opposite sides of the conductive wall, a horizontal cooling surface of the plurality of horizontal cooling surfaces, the horizontal cooling surface including a plurality of slots for accommodating the vertical cooling surfaces, and a first bend joining a vertical end of the conductive wall and a horizontal end of the horizontal cooling surface, wherein the first surfaces of the conductive walls are configured to accommodate the plurality of ice forming blocks and the second surfaces of the conductive walls are configured to come in contact with at least one of refrigerant and defrost fluid, wherein the second surface of each of the conductive walls defines a channel of a plurality of channels, and wherein, each of the plurality of channels are configured vertically one above the other; and at least one defrost fluid tube positioned on an upstream side of the plurality of conductive walls for selectively supplying the defrost fluid onto the plurality of conductive walls.

* * * * *